US008333654B2

(12) United States Patent
Amour

(10) Patent No.: US 8,333,654 B2
(45) Date of Patent: Dec. 18, 2012

(54) SYSTEMS AND METHODS FOR MANAGING CARBON CREDIT DATA

(75) Inventor: Marc Amour, New South Wales (AU)

(73) Assignee: SRG Enterprizes Pty Limited (AU)

( * ) Notice: Subject to any disclaimer, the term of this patent is extended or adjusted under 35 U.S.C. 154(b) by 248 days.

(21) Appl. No.: 12/937,126

(22) PCT Filed: Apr. 14, 2009

(86) PCT No.: PCT/AU2009/000460

§ 371 (c)(1),
(2), (4) Date: Oct. 8, 2010

(87) PCT Pub. No.: WO2009/124360

PCT Pub. Date: Oct. 15, 2009

(65) Prior Publication Data

US 2011/0045899 A1 Feb. 24, 2011

(30) Foreign Application Priority Data

Apr. 11, 2008 (AU) ..... 2008901780

(51) Int. Cl.
*A63F 9/24* (2006.01)

(52) U.S. Cl. ..... 463/25

(58) Field of Classification Search ..... 463/25
See application file for complete search history.

(56) References Cited

U.S. PATENT DOCUMENTS

2003/0036425 A1 2/2003 Kaminkow et al.
2006/0270478 A1 11/2006 Barhydt et al.

FOREIGN PATENT DOCUMENTS

WO 0038089 A2 6/2000

OTHER PUBLICATIONS

Communication: International Search Report for International Patent Application No. PCT/AU2009/000460 mailed Apr. 14, 2009.

*Primary Examiner* — William M. Brewster
(74) *Attorney, Agent, or Firm* — Katten Muchin Rosenman LLP

(57) ABSTRACT

Described herein are various systems and methods for managing carbon credits. For example, in some embodiments a lottery is used as a means for distributing carbon credits to consumers, optionally to feed a retail-level carbon market. It will be appreciated from the discussion herein that such an approach leverages general notions whereby lotteries have been traditionally used as a vehicle for funding public works.

24 Claims, 17 Drawing Sheets

SYSTEMS AND METHODS FOR MANAGING CARBON CREDIT DATA

FIELD OF THE INVENTION

The present invention relates to systems and methods for managing carbon credits, with various embodiments also providing hardware and software components for the implementation of such systems and methods. Some embodiments are directed towards a method whereby participants in a gaming activity are allocated carbon credits in conjunction with entries in the gaming activity. This is optionally implemented in conjunction with an arrangement whereby carbon credits are transactable in a retail market.

The term "carbon credit" is intended to be interpreted in the broadest sense, generally describing a transferable commodity-like asset having a utilitarian value and a financial value aspect. The term should not be necessarily limited by reference to any existing programs that use the term "carbon credit" to describe a particular transferable unit.

BACKGROUND

The following discussion of the background art is intended to place the invention in an appropriate context and to allow the unique characteristics and advantages of it to be more fully understood. However, any discussion of the background art throughout the specification should in no way be considered as an express or implied admission that such prior art is widely known or forms part of common general knowledge in the field.

A common initiative in the battle to contain climate change can be described as "activity regulation". Activity regulation essentially involves implementing regulations that affect the ability of parties to freely engage in activities that are adverse to the environment. A common focus of such regulation is containment of carbon emissions. For example, regulations may seek to impose limits on the quantity of carbon dioxide that may be emitted into the atmosphere by a corporation, industry, region, jurisdiction, or the like.

Such regulations, and initiatives such as the Kyoto protocol, have led to a general concept whereby the ability to pollute might be considered as a tradable resource. For example, the concept of "emissions trading" has become relatively well publicised, whereby a first party trades some or all of its available carbon emission quota to a second party, in exchange for a benefit (which is often financial).

From the concept of emissions trading comes the concept of a "carbon credit". In the context of carbon emissions trading, in accordance with at least some regimes, a "carbon credit" has an environmental value defined in terms of a quantum of carbon dioxide emission. A party may consume carbon credits by the emission of carbon dioxide. In some situations, a party may accrue carbon credits by partaking in initiatives that offset carbon dioxide emission (for example the planting of trees). Furthermore, a carbon credit has a financial value component. This can be quantified in terms of either a market price (i.e. the amount of money for which a carbon credit is able to be bought or sold in practice) or an intrinsic value (i.e. the economic value of a carbon credit to a particular party in terms of its economic endeavours and/or trading on securities exchanges).

A wide range of emissions trading arrangements have been contemplated and/or implemented worldwide, including "cap and trade" arrangements and "baseline and credit" arrangements. In broad terms, these have been focussed on business-to-business trading.

SUMMARY

It is an object of the present invention to overcome or ameliorate one or more of the disadvantages of the prior art, or at least to provide a useful alternative.

One embodiment provides a data processing method including the steps of receiving, in relation to a gaming activity wherein a plurality of players provide respective entry fees, entry data for a given player;

processing the entry data on the basis of an entry allocation protocol, and based on that processing, determining a level of gaming value for allocation to the player in respect of the gaming activity;

processing the entry data on the basis of a carbon credit allocation protocol, and based on that processing determining a level of carbon credit value for allocation to the player; and providing signals for effecting the allocation to the player of the determined level of gaming value and the determined level of carbon credit value;

wherein outcome data is defined in respect of the gaming activity for allowing for the identification of one or more winning entries, and wherein the processing of the entry data on the basis of the carbon credit allocation protocol is independent of the outcome data.

In some embodiments the method is performed at a single location (for example at a central server or at a terminal configured for the sale of lottery tickets), whereas in other embodiments processing is distributed between remote locations (for example in terms of a client/server or other distributed system architecture.

In some embodiments, a "level of gaming value" is defined by one or more entries in the gaming activity. However, in a general sense, the gaming value allocated to a player has a value corresponding to the entry fee provided. In some embodiments there is a commonality between players in this regard, such that each player has a corresponding spend/return ration in terms of gaming value (considered for example from the viewpoint of relative win probabilities). In some cases the entry fee may include carbon credits in place of some or all of a financial component.

Various embodiments described herein deal with the provision of signals. These may include data signals transferred within or between software and/or hardware components, including the likes of updating data within a database, passing data between components of a software application, instructing a physical printer to print a physical ticket, or instructing a remote client browser to render data indicative of an electronic ticket.

It is noted that outcome data is defined in respect of the gaming activity. This may occur independently of an embodiment of the present invention. A key concept is that the processing of the entry data on the basis of the carbon credit allocation protocol is independent of the outcome data. Carbon credits are in this manner not simply prizes in the gaming activity; rather they are provided in consideration for participation. That is, a player receives, in exchange for an entry fee, both gaming value (i.e. an opportunity to win a prize) and carbon credit value (e.g. a commodity-like asset). The level of carbon credit value corresponds to a specified number of one or more carbon credits or a specified value of carbon credits. This number or value may correspond to or be based upon an external carbon credit definition. In one example a player receives a predefined number of carbon credits which may be transferred for a benefit (for example in a retail-level carbon market). In another example a player receives a specified carbon value which may be personally offset against his/her carbon footprint (e.g. for personal carbon accounting purposes).

In one embodiment the signals include data indicative of an instruction to increase the level of carbon credit value in an account associated with the player by the determined level of carbon credit value.

In one embodiment the signals include data indicative of an instruction to generate receipt data for the player in respect of the determined level of carbon credit value. For example, the receipt data allows the player to redeem carbon credit value, for example by providing a redemption code to a computer system.

In one embodiment the method further includes:

receiving outcome data for the gaming activity, wherein the outcome data allows for the identification of one or more winning entries for the gaming activity; and providing signals for effecting, in accordance with a predetermined prize distribution protocol, the allocation of prizes to the players to whom winning entries were allocated.

Another embodiment provides a information management system including:

a component configured to communicate with an information source that maintains data indicative of an entry allocation protocol in relation to a gaming activity wherein a plurality of players provide respective entry fees, wherein the entry allocation protocol is configured for determining, on the basis of entry data received from a given player in respect of the gaming activity, a level of gaming value for allocation to the player;

a component configured for communication with an information source that maintains data indicative of a carbon credit allocation protocol, wherein the carbon credit allocation protocol is configured for determining, on the basis of entry data received from a given player in respect of the gaming activity, a level of carbon credit value for allocation to the player; and a component configured for processing entry data for a given player based on the entry allocation protocol and the carbon credit allocation protocol, thereby to determine a level of carbon credit value and a level of carbon credit value for allocation to that player; and a component for providing signals for effecting the allocation to the player of the determined level of gaming value and the determined level of carbon credit value;

wherein outcome data is defined in respect of the gaming activity for allowing for the identification of one or more winning entries, and wherein the determining of a level of carbon credit value for allocation to the player is independent of the outcome data.

A further embodiment provides a computer program product including:

a component configured to communicate with an information source that maintains data indicative of an entry allocation protocol in relation to a gaming activity wherein a plurality of players provide respective entry fees, wherein the entry allocation protocol is configured for determining, on the basis of entry data received from a given player in respect of the gaming activity, a level of gaming value for allocation to the player;

a component configured for communication with an information source that maintains data indicative of a carbon credit allocation protocol, wherein the carbon credit allocation protocol is configured for determining, on the basis of entry data received from a given player in respect of the gaming activity, a level of carbon credit value for allocation to the player; and a component configured for processing entry data for a given player based on the entry allocation protocol and the carbon credit allocation protocol, thereby to determine a level of carbon credit value and a level of carbon credit value for allocation to that player; and a component for providing signals for effecting the allocation to the player of the determined level of gaming value and the determined level of carbon credit value;

wherein outcome data is defined in respect of the gaming activity for allowing for the identification of one or more winning entries, and wherein the determining of a level of carbon credit value for allocation to the player is independent of the outcome data.

Further embodiments include the likes of computer readable media carrying code that allows the execution of a computer program product or method as described herein.

A further embodiment provides an information management system for a gaming activity wherein a plurality of players provide respective entry fees, the system including:

a component configured for implementing an entry fee apportionment protocol that defines the apportionment of a given monetary entry fee received in respect of the gaming activity between a plurality of portions, the portions including:

an administrator income portion, for providing income to an administrator of the gaming activity;

a prize pool generation portion, for funding a prize pool in respect of the gaming activity; and a carbon credit procurement portion, for the procurement of carbon credit value, that carbon credit value being for allocation to players of the gaming;

a component configured to implement an entry allocation protocol in relation to the gaming activity, wherein the entry allocation protocol controls the allocation of gaming value to a given player; and a component configured to implement a carbon credit allocation protocol in relation to the gaming activity, wherein the carbon credit allocation protocol controls the allocation of carbon credit value to a given player based on the carbon credit procurement portion of that player's entry fee;

wherein outcome data is defined in respect of the gaming activity for allowing for the identification of one or more winning entries, and wherein the allocation of carbon credit value is independent of the outcome data.

In some embodiments the entry allocation protocol controls the allocation of gaming value to a given player the based on the prize pool generation portion of that player's entry fee. In some embodiments the entry allocation protocol controls the allocation of gaming value to a given player such that the player receives gaming value corresponding to the total entry fee provided by that player. It will be appreciated that these are not mutually exclusive concepts.

In one embodiment the carbon credit procurement portion is provided to a party responsible for the issuance of carbon credits, such as a government body or party accredited by the government to issue carbon credits. In one embodiment the carbon credit procurement portion is provided to a party that partakes in predefined activities for the generation of carbon credits.

One embodiment provides a method for managing carbon credits, the method including the steps of receiving data indicative of an entry fee from a given player in respect of a gaming activity wherein a plurality of players provide respective entry fees;

on the basis of the received data and an entry allocation protocol, allocating to the player one or more entries in relation to the gaming activity; and on the basis of the received data and a carbon credit allocation protocol, allocating to the player one or more carbon credits.

One embodiment provides a method wherein the step of allocating to the player one or more carbon credits includes providing to a carbon credit administration system data indicative of the allocation.

One embodiment provides a method wherein the step of allocating to the player one or more carbon credits includes defining an identifier indicative of the allocation, the identifier allowing redemption of the one or more carbon credits providing to a carbon credit administration system data indicative thereby to increase the level of carbon credits in a carbon credit account.

One embodiment provides a method wherein the step of allocating to the player one or more carbon credits includes providing a signal for increasing the level of carbon credits in a carbon credit account.

One embodiment provides a method including the step of receiving, from a carbon credit issuing authority, data indicative of the issuance of a quantum of carbon credits, the carbon credits being for allocation to the players.

One embodiment provides a method including the steps of identifying one or more winning entries for the gaming activity; and awarding prizes to the players to whom winning entries were allocated in accordance with a predetermined prize distribution protocol.

One embodiment provides a method for managing carbon credits, the method including providing a gaming activity as a mechanism for distributing carbon credits to a retail-level market.

One embodiment provides a method for managing carbon credits, the method including the steps of:

maintaining a carbon credit account database, the database including a plurality of accounts, each account including:

data indicative of an account identifier; and data indicative of an allocated none or more carbon credits;

receiving data indicative of a transaction between a consumer and a carbon consumptive user for transferring one or more allocated carbon credits from an account associated with the consumer to an account associated with the carbon consumptive user.

One embodiment provides a method for providing a retail-level carbon credit market, the method including the steps of:

maintaining a carbon credit account database, the database including a plurality of accounts, each account including:

data indicative of an account identifier; and data indicative of an allocated none or more carbon credits;

receiving data indicative of a transaction between a consumer and a carbon consumptive user for transferring one or more allocated carbon credits from an account associated with the consumer to an account associated with the carbon consumptive user.

One embodiment provides a method wherein the allocated none or more allocated carbon credits are internal carbon credits, and the method includes maintaining data indicative of a pool of external carbon credits, wherein there is defined a predefined exchange rate between the internal carbon credits and the external carbon credits.

One embodiment provides a method wherein the predefined exchange rate varies over time.

One embodiment provides a method wherein the predefined exchange rate varies over time as a function of the market price of external carbon credits.

One embodiment provides a computer-readable carrier medium carrying a set of instructions that when executed by one or more processors cause the one or more processors to carry out a method as discussed herein.

One embodiment provides a computer program product for performing a method as discussed herein.

One embodiment provides a computer system configured to perform a method according as discussed herein.

One embodiment provides a method substantially as herein described with reference to any one of the embodiments of the invention illustrated in the accompanying drawings and/or examples.

One embodiment provides a computer-readable carrier medium substantially as herein described with reference to any one of the embodiments of the invention illustrated in the accompanying drawings and/or examples.

One embodiment provides a computer program product substantially as herein described with reference to any one of the embodiments of the invention illustrated in the accompanying drawings and/or examples.

One embodiment provides a computer system substantially as herein described with reference to any one of the embodiments of the invention illustrated in the accompanying drawings and/or examples.

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

In the claims below and the description herein, any one of the terms "comprising", "comprised of", or "which comprises" is an open term that means including at least the elements/features that follow, but not excluding others. Thus, the term "comprising", when used in the claims, should not be interpreted as being limitative to the means or elements or steps listed thereafter. For example, the scope of the expression a device comprising A and B should not be limited to devices consisting only of elements A and B. Any one of the terms "including", "which includes" or "that includes" as used herein is also an open term that also means including at least the elements/features that follow the term, but not excluding others. Thus, "including" is synonymous with and means the same as "comprising".

Similarly, the term "coupled", when used herein, should not be interpreted as being limitative to direct connections only. The terms "coupled" and "connected," along with their derivatives, may be used. The scope of the expression a "device A coupled to a device B" should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

As used herein, the terms "gaming" and "gaming activity" should be construed broadly so as to encompass any form of gambling, gaming, or wagering, including but not limited to:

- Lotteries and lottery type games. In the context of the Australian market, particular examples include "Lotto", "Oz Lotto", "Powerball", "Art Union Lotteries", and the like. In the context of the US market, particular examples include "Hot Lotto", "Mega Millions", "Powerball", "Paycheck", and "Tri-State".
- Traditional draw lotteries, instant lotteries and "scratch" lotteries.
- Raffles, or other games where a player is provided with one or more unique tickets carrying respective ticket identifiers, and one or more winners are identified based on the selection of one or more winning ticket identifiers.
- "Keno", "Bingo" and "Housie", "Tombola" and "Chinese Raffle" style games where players seek to reconcile their own numbers with numbers drawn from an independent objective source.
- Sports betting activities and football pools, whether pari-mutuel or "fixed-odds" based.
- Events-based betting activities involving such outcomes as political contests, Royal or noteworthy births, weather outcomes and natural phenomena.
- Totalisators.
- Sweepstakes for any events such as horse, dog or any other form of racing, sporting contests, political contests and the like.
- PC-based and other electronic gaming contests, including online chance-based, skill-based or combination chance/skill-based gaming contests. These include online video games, where outcomes are in part dependant on a player's skill, and in some cases in part dependent on random factors including chance.
- Other games or contests of skill and/or knowledge and/or chance.
- Chance-based games played on poker and other electronic gaming machines.
- Any games of skill and/or chance involving one or more unknown outcomes, whether pari-mutuel or "fixed-odds" based.
- Gaming activities of the sort described in PCT/AU2007/000774.
- Gaming activities of the sort described in PCT/AU2007/000780

It will be appreciated that, in all of these examples, multiple players provide respective entry fees and, in exchange for the entry fees, the players are respectively provided with one or more entries.

The term "pari-mutuel" refers generally to a gaming arrangement whereby prizes are funded in whole or in part by entry fees. This term is intended to be synonymous with "paramutual", "para-mutual", "parimutuel" "mutual betting" and other variants.

A "method for providing a gaming activity" includes substantially any method by which a gaming activity is provided. This includes, but is not limited to, methods performable by administrators of gaming activities, methods performable by vendors of entries in gaming activities, methods performable by players, computer implemented methods performable in relation to the administration of gaming activities and/or sale of entries in such gaming activities, and so on. Likewise, a "system for providing a gaming activity" includes substantially any hardware component or group of hardware components associated with the performance of a method for providing a gaming activity. For example, such systems include information systems maintained or implemented by or on behalf of administrators of gaming activities, vendors of entries in gaming activities, or the players themselves.

As used herein, the term "gaming operator" describes a party or group of parties responsible for the carriage and administration of a gaming activity. That is, a gaming operator is responsible for tasks including, but not limited to defining entry parameters and other predefined terms and conditions for the gaming activity, offering for sale entries in exchange for entry fees, receiving entry fees from players, allocating entries to players in exchange for those entry fees, identifying one or more winning entries, and arranging for the distribution of prizes among the players. In practice, these tasks are often performed by a number of parties. For example, a first category of party (such as vendors or agents) may be responsible for offering for sale entries in exchange for entry fees and receiving entry fees from players, whilst a second party may be responsible for identifying one or more winning entries. However, this is ignored for the present purposes, and the term "gaming operator" should be read sufficiently broadly so as to cover whatever group of related and/or unrelated parties are responsible for the carriage and administration of a particular gaming activity.

Thus, in some cases, a gaming activity may be provided by a plurality of parties, which might or might not be related or affiliated. Additionally, in some cases, a gaming activity may include a plurality of sub-activities, such as individual lotteries, that might in themselves be provided by differing parties. However, it should be appreciated that a plurality of such sub-activities, regardless of the nature of the relationship between providing parties, should be considered as a single gaming activity in the context of the present disclosure. In some cases, a plurality of sub-activities may be conducted by differing parties in different locations and/or with differing branding. However some or all of the entry fees from these sub-activities might be notionally or physically combined into a common pool, for example to facilitate investment, risk management or infrastructure sharing activities. In such cases, the sub-activities should certainty be collectively regarded as a single gaming activity in the context of the present disclosure.

BRIEF DESCRIPTION OF THE DRAWINGS

Preferred embodiments of the invention will now be described, by way of example only, with reference to the accompanying drawings in which.

DETAILED DESCRIPTION OF PREFERRED EMBODIMENTS

Figure 1:
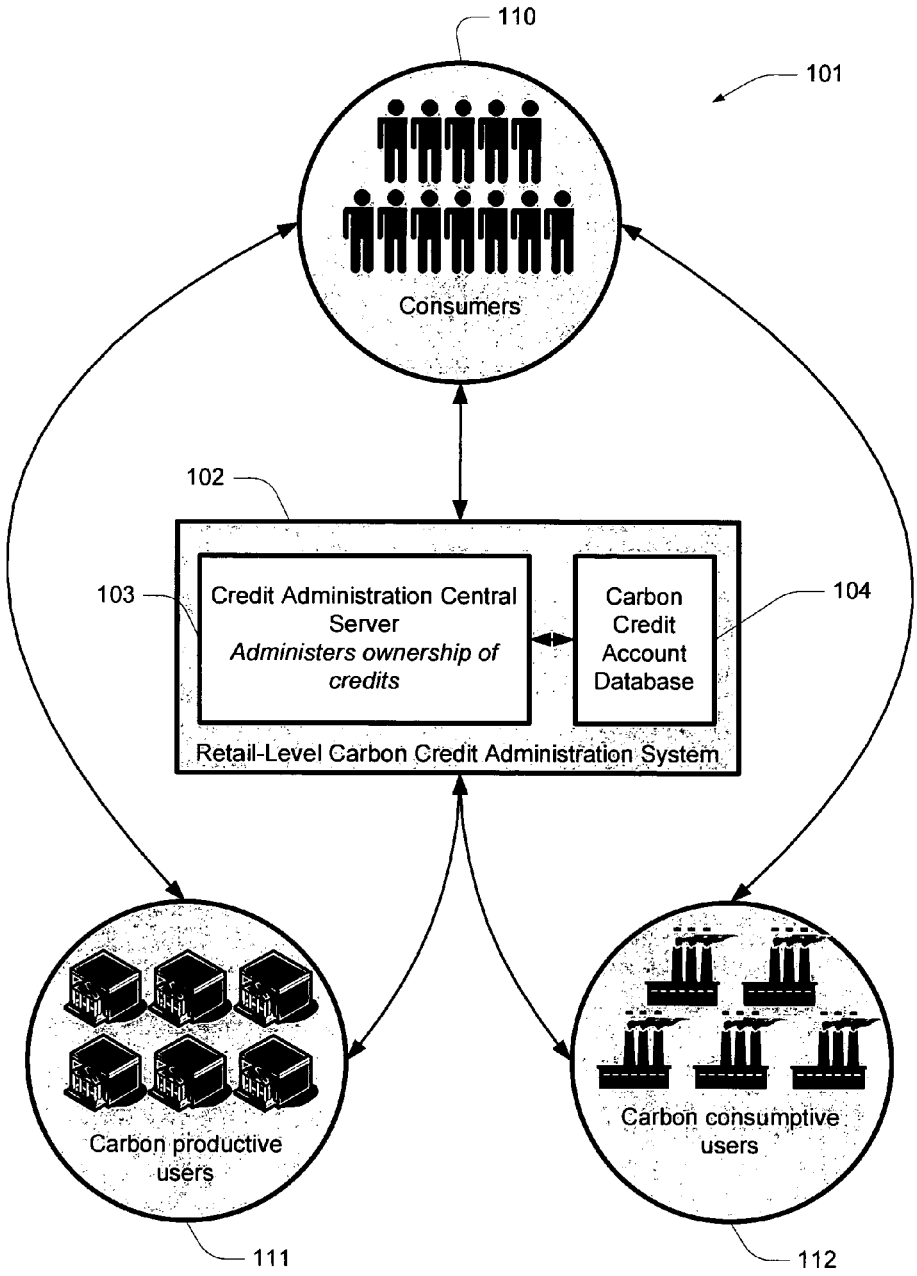
FIG. 1 illustrates an infrastructure for managing carbon credits according to one embodiment.

Described herein are various systems and methods for managing carbon credits. In some embodiments, such systems and methods are directed towards the distribution of carbon credits via a gaming activity (such as a lottery), although not in the context of prizes. Rather, carbon credits are provided in consideration for participation, in a manner quite independent the prize determination/distribution aspects of the gaming activity. In other embodiments, such systems and methods are directed towards creating a retail-level carbon credit market for supporting a wider environmental initiative. For example, in some embodiments a lottery is used as a means for distributing carbon credits to consumers to feed a retail-level market. It will be appreciated from the discussion herein that such an approach leverages general notions whereby lotteries have been traditionally used as a vehicle for funding public works.

Meaning of "Carbon Credit"

For the purposes of the present disclosure, the term "carbon credit" is intended to be interpreted in the broadest sense, as encompassing any transferable commodity-like asset having a utilitarian value aspect and a financial value aspect. The term is intended to cover a wider range of assets, presently existing or otherwise, that have both a utilitarian value aspect (i.e. they provide the right to partake in a prescribed activity) and a financial value aspect (i.e. they are able to be bought and sold in a financial sense). The selection of the term "carbon credit" for the present purposes is to some extent framed around popular conceptions associated with the term at the time of drafting the present specification. However, the resulting environmentally-charged implications should not be read as necessarily limiting.

In some cases the utilitarian value is an environmental utilitarian value, such as a permission or right to partake in an environmentally harmful (or allegedly environmentally harmful) activity. In some cases such an environmental utilitarian value is measured in terms of a quantum of carbon dioxide emission (measured, for example, in terms of mass). However, other environmental utilitarian values are also contemplated, these being quantified, for example, in terms of effluent discharge into oceans and waterways, production and/or distribution of non-biodegradable substances (such as plastics, particularly plastic bags), extraction of natural resources, and so on.

The utilitarian value is typically standardised by a controlling body, and may be fixed at a given point in time (or fixed for a defined period). For example, a controlling body determines that the utilitarian value of a single carbon credit is a right to emit 1 tonne of carbon dioxide, or partake in a predefined level of another prescribed activity. The controlling authority may adjust regulations over time.

On the other hand, the financial value is, in many cases, non-standardised (and variable). For example, in some cases the financial is quantified in terms of a market price that varies in response to market forces such as supply and demand. The financial value may also be quantified in terms of an intrinsic value, which varies over time, and from party to party. For example, a given party can perform analysis (such as net present value analysis) to determine the value of a carbon credit in economic terms. This may involve determining anticipated net financial gains associated with consuming the utilitarian value of a carbon credit. For instance, where the utilitarian value is an environmental utilitarian value quantified in terms of a unit amount of carbon dioxide, a corporation may determine the net profit (or net mitigation in loss) associated with partaking in activities that emit that unit amount of carbon dioxide. It will be appreciated that, in simple terms, it may be economically sensible to purchase carbon credits where the intrinsic value is greater than the market price.

Various forms of commodity that fall within the general notion of "carbon credit" are known. These include, but are not limited to, the following:

Certified Emission Reductions (CERs). Carbon credits of this nature are issued by the Clean Development Mechanism (CDM) Executive Board, based on the rules of the Kyoto Protocol. These arise primarily from approved emissions reduction projects. CERs can be held by governmental and private entities via electronic accounts, and are intended to allow inter-jurisdictional movement of carbon credits. For example, credits are generated by emissions reduction initiatives in a first jurisdiction, and obtained in a second jurisdiction to effectively increase the emissions cap in that second jurisdiction.

Emission Reduction Units (ERUs), as implemented under the European Union Emission Trading Scheme (EU ETS). Under the EU ETS at present, prescribed carbon dioxide emitters within the EU are obliged to monitor annual emissions. Based on this, they are required to provide to a central authority an environmental value in ERUs that is equivalent to their CO2 emissions in that year. It is intended for ERUs to be tradable with CERs as equivalents.

Various other carbon credit types have been implemented in further jurisdictions. These include both Kyoto compliant/certified credit types, and others. For the sake of the present disclosure, the term "carbon credit" should not be limited to any particular mechanism. In fact, some embodiments described below make use of an implementation-specific definition of carbon credit, which is optionally related to the definition of a carbon credit for an arrangement external of the implementation.

In some cases the utilitarian value is arguably a "feel good" value, in the sense that it does not provide any positive rights, but rather confirms that certain actions have been taken. For example, a person is allocated a carbon credit, and in doing so is assured that they have contributed to an environmentally sound initiative that resulted in the generation of that carbon credit, although the credit has no specific economic use to the person (although a utilitarian value, for example in the sense of personal gratification).

Retail-Level Carbon Credit Management Infrastructure

In overview, some embodiments include or relate to a retail-level carbon credit management infrastructure. For example, embodiments include hardware, software, and methodologies associated with such an infrastructure.

FIG. 1 schematically illustrates a retail-level carbon credit management infrastructure 101 according to one embodiment. Infrastructure 101 includes a carbon credit administration system 102, which includes a central server 103. Although only a single sever is illustrated, in some cases the functionality of server 103 is provided by a plurality of distributed servers connected to a common communications network. Server 103 operates in conjunction with a carbon credit account database 104. This database maintains data indicative of a plurality of "carbon credit accounts", each account having a respective owner, and a maintained value in carbon credits (which may be zero). Each account is identifiable on the basis of an account identifier.

In the present embodiments, a range of parties holds carbon credit accounts. An important example is consumers. In overview, arrangements are implemented such that a consumer is able to accrue carbon credits in his/her (or "its" in the context of a non-human user) carbon credit account by partaking in various activities. Examples of such activities include:

Direct purchase of carbon credits from a distributor, which in some cases includes an administrator or affiliate of system 102.

Participation in predefined activities, including abatement activities, carbon offset activities, or other activities deemed to have an environmentally positive impact.

Purchase of predetermined products. For example, a consumer enters into a transaction with a supplier for the purchase of goods and/or services. The consumer provides an agreed level of consideration and, in exchange for that consideration, is provided with the relevant goods and/or services in combination with one or more carbon credits.

A specific example, dealt with in more detail further below, is the participation in a prescribed gaming activity (i.e. the purchase of a predetermined product in the form of one or more entries in a gaming activity), such as a lottery that rewards participants with carbon credits. The present inventor has also developed an arrangement whereby carbon credits may be accrued from the use of public transport.

The manner in which credits are physically accrued varies between situations. For example, in some cases an increase in the value of carbon credits maintained in a consumer account is responsive to an instruction from a third party, such as a supplier. This instruction is in some embodiments accompanied with a value in funds to purchase the relevant credits on behalf of the consumer, or the credits themselves (or an instruction to transfer those between carbon credit accounts). In some cases a consumer is provided with a receipt or the like carrying an identifier or code, and inputs that identifier or code to an interface provided by system 102 thereby to redeem a value carbon credits associated with the relevant receipt or the like.

System 102 is additionally configured to implement carbon credit transactions between accounts in database 104. Subject to such a transaction, the level of carbon credit in a particular account is decreased, and the credit in another account is correspondingly increased.

Accounts in database 104 are not held solely by consumers, and may also be held by other parties (such as suppliers). However, it will be appreciated that any distinction between "consumers" and "suppliers" is somewhat arbitrary, as a given party might fall into either category (or both) depending on the specifics of a given situation.

In the context of FIG. 1, three categories of account holder are notionally defined for the purposes of illustration. Specifically, these categories are consumers 110, carbon productive users 111, and carbon consumptive users 112. It will be appreciated that a given party may fall into any one or more of these categories.

Consumers 110 both accrue carbon credits from carbon productive users 111, and dispose of carbon credits by allocating those to carbon consumptive users. For example, subject to data indicative of a transaction between a consumer and a carbon consumptive user, one or more carbon credits are transferred from an account associated with the consumer to an account associated with the carbon consumptive user. Consumers' interest in system 102 generally stems from benefits associated with the ability to realize value associated with carbon credits that are accrued through various activities.

Carbon productive users 111 are, in essence, a source of carbon credits for system 102. For example, this category is intended to cover the likes of organisations that partake in abatement programs for the generation of carbon credits, authorised carbon credit issuing authorities, or simply parties who otherwise wish to dispose of or distribute carbon credits. In some cases, users 111 include a government body responsible for the issuance of carbon credits. This body issues those credits via system 102 as a means for distributing the credits to consumers thereby to feed a retail-level market.

Carbon consumptive users 112 include the likes of businesses that wish to obtain additional carbon credits. By way of system 102, such businesses are able to obtain credits from the retail market, for example by offering benefits or rewards within the retail market. For example, businesses may accept payment in carbon credits via system 102 in exchange for whole or partial payment for goods and/or services. In one example, a consumer is able to at least partially pay an invoice for electricity services by way of carbon credits via system 102.

It will be appreciated that the general infrastructure described above creates a model whereby businesses compete for carbon credits in a retail market. Those businesses for which carbon credits have a higher intrinsic value will inherently be able to offer a greater reward to consumers (for example a more favourable carbon credit to currency conversion rate for the purchase of goods and/or services). However, consumers nevertheless retain some control over the manner in which credits flow, by virtue of a collective social conscience. For example, although a particular business may offer a greater reward in exchange for credits, consumers may shy away from providing credits to that company due to a perception that the environmental impacts associated with that company's activities are unjustified. This may, in turn, cause the relevant business to adopt a different environmental policy.

"Internal" and "External" Carbon Credits

Carbon credits transacted within the bounds of infrastructure 101 and system 102, at least in some embodiments, do not directly correspond with carbon credits according to a wider regime. This leads to the notions of "internal" and "external" carbon credits. In some embodiments, the former are essentially units of the latter. In broad terms, an administrator of system 102 maintains a pool of external carbon credits for providing the internal carbon credits. External carbon credits may include recognised units such as CERs. In this manner, it is possible to conceptualise internal carbon credit ownership as partial ownership in a CER, or in a pool of CERs.

Where a wider regime deals in "external" carbon credits each having a utilitarian environmental value of, for example, 1 Tonne of carbon dioxide, the "internal" carbon credits of infrastructure 101 might each have a utilitarian environmental value of $1/1000^{th}$ of a Tonne. In this manner, much smaller unit carbon credit ownerships are possible within the infrastructure, providing further liquidity flexibility in the asset for the purposes of a retail market. In such cases, an account holder is able to "cash in" internal carbon credits for external carbon credits. For example, based on the present example, a carbon consumptive user is able to cash in 1000 internal credits for a single external credit.

The mechanics underlying internal and external credits varies between embodiments. For instance, although the example above deals with a situation whereby an internal/external carbon credit exchange protocol is based on utilitarian environmental value, in other embodiments the exchange is based on market price. For example, the number of internal carbon credits exchanged for a single external carbon credits (or vice versa) varies over time with fluctuations in the market price of external carbon credits.

Creation of Carbon Credit Accounts

In the present embodiments, a carbon credit account is identifiable on the basis of an account identifier. This account identifier may be, for example, a numeric, alphanumeric, or alphabetic string that identifies a unique account in database 104.

Three examples of how account identifiers are provided to consumers are considered below:

- In some embodiments, one or more of the consumers are provided with a respective machine readable token or passcode which is indicative of an account identifier for the relevant consumer, or from which an account identifier for the relevant consumer is able to be derived. In some such embodiments, consumers undergo a registration procedure for the creation of their accounts. The term "machine readable" describes the likes of tokens including magnetic strips, printed/embossed material, RFID tags, barcodes, smartcard information, and so on. Machine readable tokens are read by appropriate hardware (for example, by "swiping" a card having a magnetic strip), and the machine readable information processed to derive an account identifier.
- In some embodiments one or more of the consumers have respective pre-existing machine readable tokens or passcodes. For example, this token might be a pre-existing credit card, debit card, loyalty card, picture ID, driver's licence, passport, healthcare card (such as "Medicare" in Australia), social security card or the like—substantially any machine readable token capable of uniquely identifying a particular consumer may be used. In some such embodiments, consumers undergo a registration procedure for the creation of their accounts. However, in other embodiments an account is inherently defined for a consumer upon the reading of a token or acceptance of a passcode that has previously not been presented in the context of system 200.
- In some embodiments, fingerprint scanners, iris or retina scanners, voice analysis software or similar technologies may be used to generate or verify account identifiers based on data indicative of unique physical characteristics of the consumer.

It will be appreciated that other approaches are implemented in other embodiments.

Although each account identifier identifies only a single account, in some embodiments multiple account identifiers identify a single account. For example, in some embodiments a single consumer account is identified upon the presentation of either a credit card, passcode, or other loyalty card attributable to a given consumer. For instance, a consumer presents a credit card for the purposes of providing an account identifier for one transaction, and the same consumer presents a loyalty card for the purposes of providing an account identifier for another transaction. Assume, for the sake of example, that each of these transactions results in an attributable carbon credit amount. These amounts would be "managed" as described herein by reference to different account identifiers stemming from the credit card and loyalty card respectively. However, the consumer might wish for both of these amounts to go to a single consumer account, essentially requiring an account that has multiple account identifiers. In some cases this is implemented by initially creating multiple consumer accounts, and subsequently allowing a consumer to whom these accounts are commonly attributable to collate the accounts, for example by way of options provided in a web-based interface.

Carbon Credit Distribution Via Gaming Activities

Some embodiments include or relate to a gaming activity that serves as a vessel for the distribution of carbon credits to a retail level market. In overview, a plurality of players provide respective entry fees, and in exchange for these entry fees are respectively allocated one or more entries and one or more carbon credits. Subject to the outcome the gaming activity, one or more of the entries are determined to be winning entries. Prizes are then distributed to the players to whom winning entries were allocated. The allocation of carbon credits is quite independent from the distribution of prizes, and other chance-based aspects of the gaming activity. The carbon credits are not allocated as prizes at all. Rather, they are provided as consideration for participation, with an entry fee being exchanged for both gaming value and carbon credits.

The present examples focus primarily of the example of a lottery. However, other embodiments are implemented in conjunction with other gaming activities, as broadly defined in the "Summary" section above. Some embodiments make use of a gaming activity as disclosed in PCT/AU2007/000774. For example, that disclosure teaches gaming activities whereby players are able to receive a partial or full refund on their entry fees by selection of a "risk profile". Indeed, in some embodiments a player is provided with an option to participate on the basis that his or her entry fee is wholly refundable while retaining the opportunity to win prizes, potentially alongside more risky though still modified participation by other players.

Historically, lotteries have been used as a means for funding public works. Generally speaking, the funds associated with an entry fee are split between a game operator (about 10%), prize pool generation (about 30%-60%) and government taxes and the like (also about 30%-60%). The government taxes and the like are in whole or in part directed towards a purpose selected in line with policy determinations, often including the likes of hospitals, social welfare, and so on. In the present embodiments, proceeds from a lottery are still diverted towards such a purpose, in some cases by the government, but in other cases by another party (which may be the game operator or an administrator of system 102) by the purchase of carbon credits (optionally from a wholesale market).

The allocation of carbon credits provides additional benefits (potentially financial benefits) to the player. In some cases, for example in the context of infrastructure 101 above, players are able to redeem these carbon credits with consumptive users thereby to realise a benefit. In one embodiment, players use their carbon credits to partially or wholly pay invoices for utilities such as gas and electricity (the issuers of such invoices being registered as carbon consumptive users with system 102). Alternately, in some embodiments system 102 allows users to "cash-in" carbon credits for a direct financial reward (optionally being based on current market prices).

The manner by which carbon credits are made available for distribution via such a lottery is discussed in more detail further below in the section entitled "Carbon Credit Funding Models". Two particularly significant models are as follows:

- The proportion of entry fees attributable to government taxes and the like is less than in a traditional lottery, allowing for a proportion of the entry fees to be allocated to the purchase of carbon credits. This may be a condition of a government license granted to the gaming operator.
- The government issues carbon credits to the lottery operator as a means for feeding a retail-level carbon credit market, and optionally diverts a proportion of the government taxes and the like to environmental initiatives.

Figure 2:
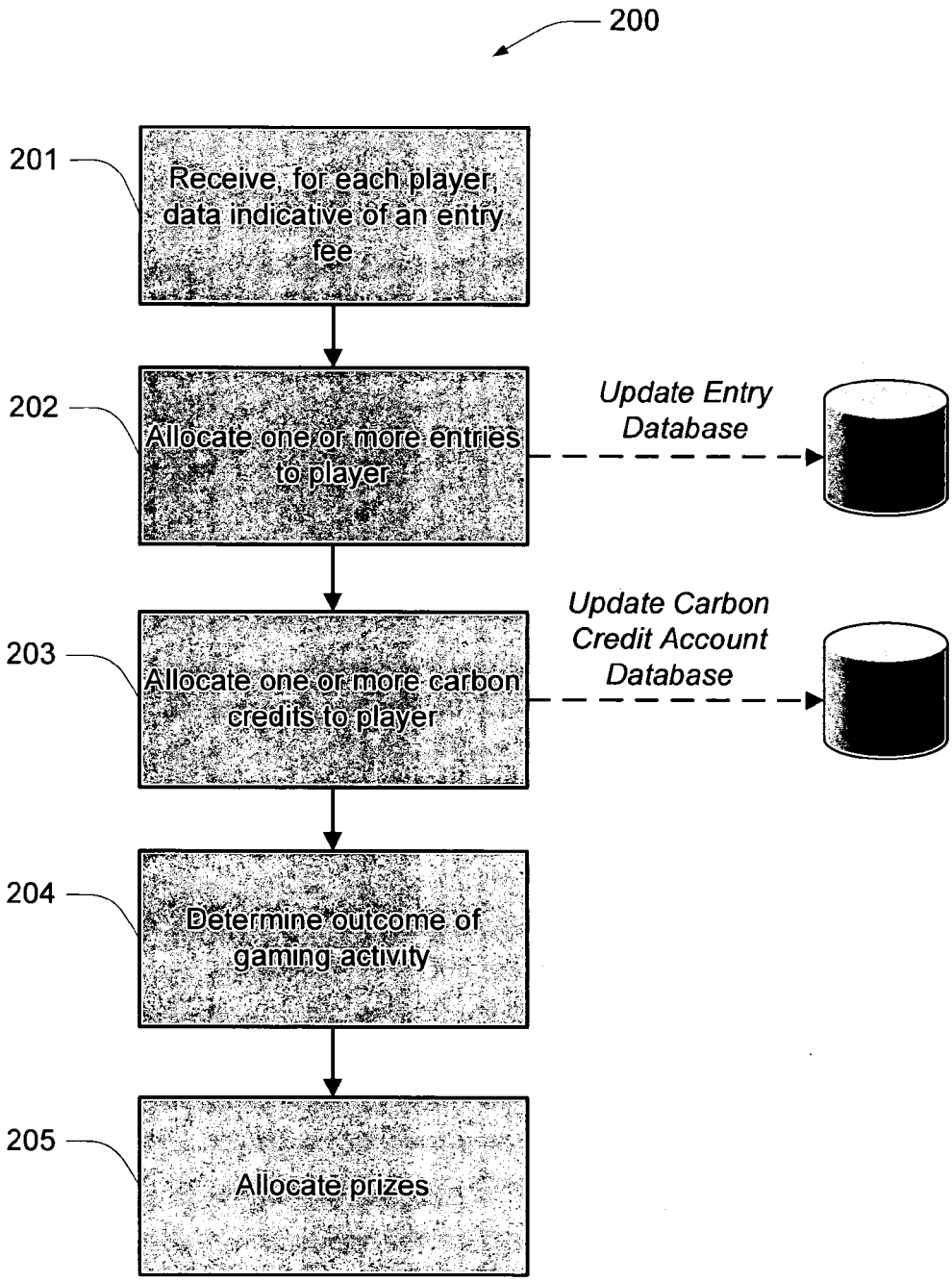
FIG. 2 illustrates a method according to one embodiment.

In accordance with the present embodiments, players who provide entry fees are allocated, in addition to one or more entries, one or more carbon credits in accordance with a system such as system 102. In this vein, FIG. 2 illustrates a method 200 according to one embodiment. This method is, in some embodiments, performed on the basis of software instructions executing on one or more processors of a computer system or other machine responsible for the implementation of gaming functionalities.

Step 201 includes receiving, for each player, data indicative of an entry fee. The manner by which this data is received, and the context in which it is received, varies between embodiments. For example, entry fees may be received subject to transactions conducted at ticket agent POS terminal, ticket vending kiosks, via a purchase interface coupled to a server over a communications network (for example a purchase interface in the form of a website connected to a gaming administration server over the Internet), and so on. The crux of step 201 is that a machine responsible for the allocation of entries is provided with data that allows for a determination of the number and/or nature of entries that should be awarded. In some embodiments, so as to fulfil this objective, the data received at step 201 includes additional data. For example, in some embodiments leveraging gaming activities disclosed in PCT/AU2007/000774, the data includes data indicative of a "risk profile", as is required for the purposes of determining an appropriate manner for allocating entries to the relevant player.

Step 202 includes, for each player, processing the data received at step 201, and allocating one or more entries to that player. The manner by which processing occurs is very much dependent on the structure of the gaming activity, being particularly dependent on entry allocation protocols that are in place. Likewise, the manner by which entry allocation occurs varies. In a general sense, allocation includes updating an entry database with data indicative of the allocated entries. For example, unique entry identifiers are defined for each of the allocated entries. This allows for identification of winning entries, and redemption of prizes associated with winning entries. In some embodiments data indicative of the entry identifier (or identifiers in the case of multiple entries) is communicated to allow the generation of an entry receipt (for example the printing of a lottery ticket, or the rendering in a client machine of an electronic lottery ticket), or the association of the entry identifiers with a smartcard or the like.

In some embodiments the database is configured such that the entry identifiers are associated with a player account for the player that provided the entry fee. This player account is identifiable by an account identifier, which is also carried by a loyalty card or the like (or associated with a username/password combination) carried by the player.

Step 203 includes allocating one or more carbon credits to the player. Much like step 202, this presently includes updating a database. As illustrated in FIG. 2, the database in question is a carbon credit account database, such as database 104. However, the updating of that database is not in all cases a direct result of step 203 (i.e. there are intermediate processes). Some examples are considered below:

- In some embodiments, data indicative of a carbon credit receipt is communicated for provision to the player. This receipt includes an identifier which is able to be inputted into an interface provided by system 102 thereby to credit a consumer account in database 104 designated by the player by the one or allocated more carbon credits.
- In some embodiments, the player provides (purposely or inherently) data indicative of a carbon credit account identifier for system 102 when providing an entry fee. In this manner, a gaming administration system responsible for performing method 200 is able to provide a signal to system 102 for the updating of database 104.

Other arrangements are present in further embodiments. For example, in one embodiment gaming functionalities and carbon credit management infrastructure are provided by a common system.

The manner in which characteristics of the one or more carbon credits are identified for the purposes of step 203 (such as the number of carbon credits) are discussed in more detail further below in the section entitled "Carbon Credit Allocation Protocol".

Step 204 includes identifying one or more winning entries. In the context of some gaming activities, there is only a single winning entry, whereas in other gaming activities there are multiple winning entries. In overview, the gaming operator has in place predefined criteria for determining, based on the outcome of the gaming activity, which entries are "winning entries" (entries in respect of which a win-event applies) and which entries are "non-winning entries" (entries in respect of which a no-win event applies). In one simple example, the gaming activity involves wagering on the outcome of a sporting event between two teams, Team A and Team B. Assume a given entry is placed on the basis of a wager that Team A will be victorious. If the outcome of the sporting event reveals that Team A was indeed victorious, that entry would be identified as a winning entry. Otherwise, it would be identified as a non-winning entry. It will be appreciated that identifying winning entries is a more detailed procedure in, for example, complex lottery style games.

Step 205 includes distributing a prize pool of prizes to players to whom the winning entries were allocated. That is, a prize pool is used to fund one or more prizes, and these prizes are awarded to the winning players (or player, in the event that there is only one prize, or in the event that one player wins all prizes). This is carried out in accordance with a predefined prize distribution protocol. There is no requirement that, at the completion of step 205, the relevant players have physically received prizes. Rather, in some embodiments, step 205 includes simply making it possible for winning players to obtain prizes by redeeming their entries in a designated manner (for example by updating the entry database accordingly). In some practical cases, winning entries are never redeemed, and the corresponding prizes never physically awarded (these may be dealt with in accordance with an unclaimed prize management protocol).

The prize pool, and prizes distributed from that prize pool, need not be monetary in nature. For example, in some embodiments the prize pool includes goods and/or services for distribution as prizes. Examples include, but are not limited to, automobiles, consumer electronic devices, fashion products, retail goods, livestock, real property, professional services, education services, hospitality services, discount coupons, entries in other gaming activities and so on.

It will be appreciated that method 200 described aspects of a relatively simple gaming activity, and is provided for the sake of illustration only. Generally speaking, step 203 is able to be implemented in conjunction with other more complex gaming activities.

Carbon Credit Allocation Protocol

As foreshadowed, following receipt of data indicative of an entry fee from a player, one or more carbon credits are allocated to that player. The number of carbon credits allocated (and optionally other characteristics of the carbon credits) is determined on the basis of a carbon credit allocation protocol. Several exemplary aspects apparent in various such protocols are considered below:

Entry fee based proportionality. In some embodiments, there is a proportional relationship between entry fee quantum and carbon credit allocation. For example, X carbon credits are allocated for each $Y of entry fees provided.

Contribution based proportionality. This is similar to the example above, although rather than simply considering the entry fee, there is consideration of the contribution a player actually makes to a prize pool. This is particularly significant in terms of gaming activities such as those disclosed in PCT/AU2007/000774, where the selection of a risk profile can affect the contribution to a prize pool for a given quantum of entry fee.

Allocation based on "internal" carbon credit value. In such cases, allocation is not affected by market forces, and the number of carbon credits allocated is constant over time.

Allocation based on "external" carbon credit value. In such cases, allocation is affected by market forces, and the number of carbon credits allocated increased and/or decreases depending on the market price of external carbon credits.

Flat rate allocation. In such cases, a flat rate quantum/market price value of carbon credits is allocated per player and/or per transaction, without reference to factors such as entry fee quantum and/or contribution.

It will be appreciated that these approaches, other approaches, and combination approaches are present in various embodiments.

Gaming Infrastructure

Exemplary gaming infrastructures are shown in FIG. 3A to FIG. 3E. In overview, gaming transactions occur between a player 301 and a gaming agent 302. For the purpose of these examples, player 301 represents a the likes of a single human player, group of participants who collectively purchase one or more entries, or automated process configured to purchase entries. Gaming agent 302 represents personnel, hardware, and/or software that interacts with player 301. For example, the gaming agent may include a web-based interface, a gaming terminal operated by a human operator, a kiosk with which the player directly interacts, or the like. In essence, the player provides to the gaming agent an entry fee (for example in cash or by way of electronic transaction) and the gaming agent provides to the player, in return, one or more entries and one or more carbon credits. As noted above, the manner in which these is provided varies, optionally including printed or electronic receipts/tickets, updating of a back-end account for which the player has an identifier, and so on. Gaming agent 302 is in communication with a gaming administration system 303. System 303 includes a central server 304 (optionally defined by a plurality of distributed components) operating in conjunction with an entry database 305. Server 304 is responsible for implementing method 200, or a variant thereof.

Figure 3A:
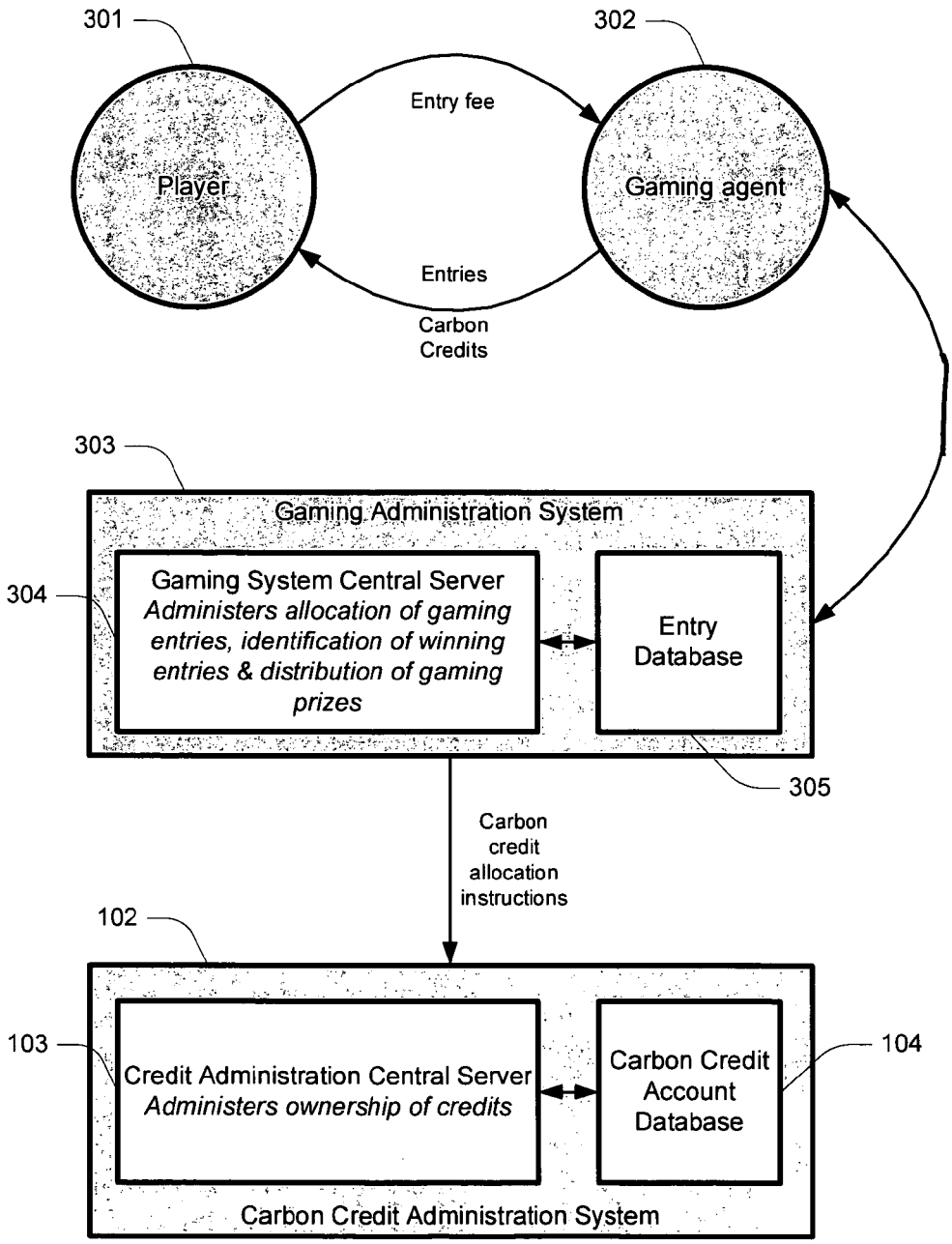
FIG. 3A illustrates gaming system and carbon credit management system according to one embodiment.

In the example of FIG. 3A, system 303 communicates directly with carbon credit administration system 102, and provides carbon credit allocation instructions. These instructions are, in some cases, indicative of a value/quantum of carbon credits for allocation to an identified carbon credit account. In other embodiments the instructions are indicative of a value/quantum of carbon credits and an associated redemption code. The redemption code is later provided to system 102 by the player so as to allocate the relevant credits to an appropriate account.

Figure 3B:
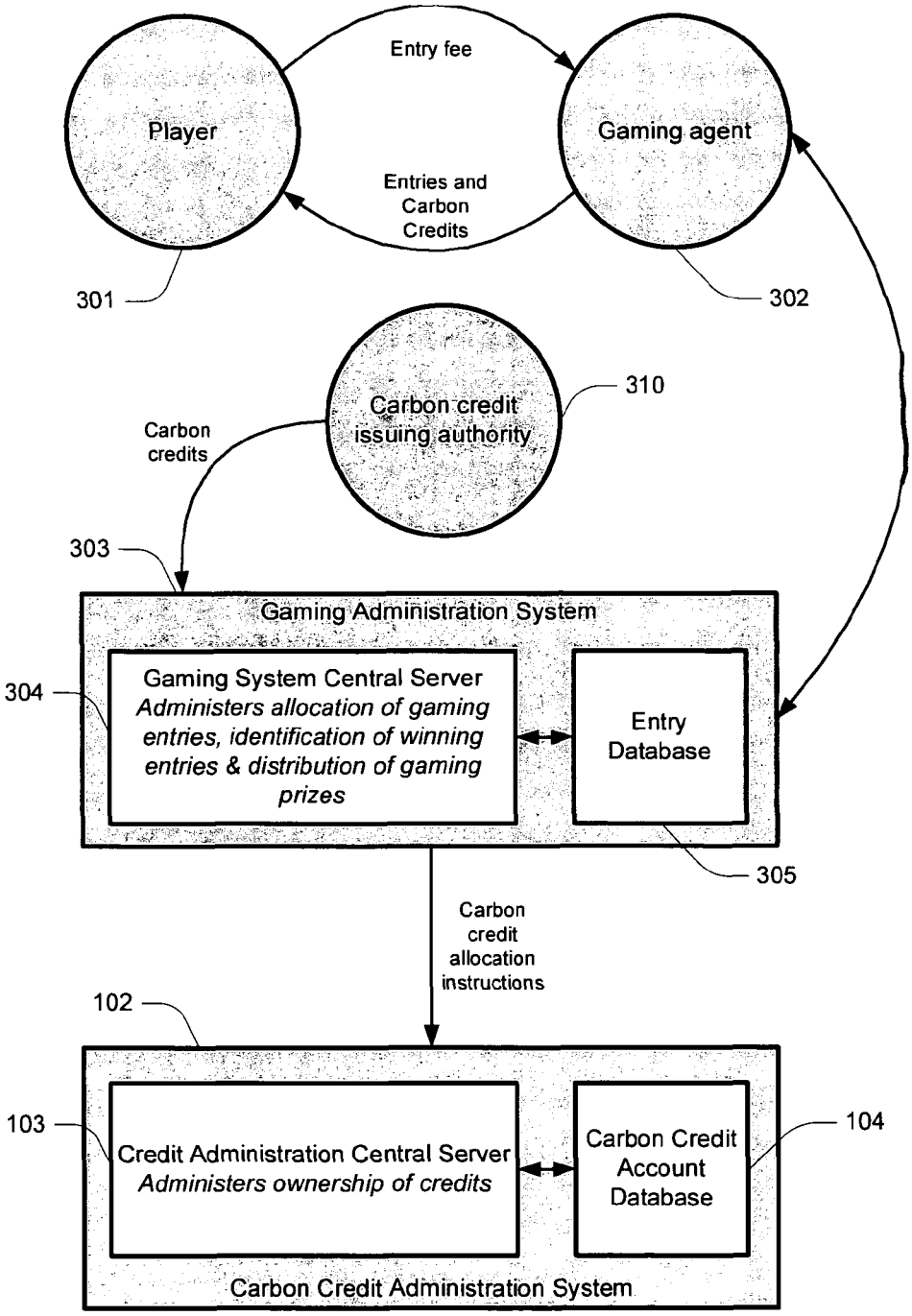
FIG. 3B illustrates gaming system and carbon credit management system according to one embodiment.
Figure 3C:
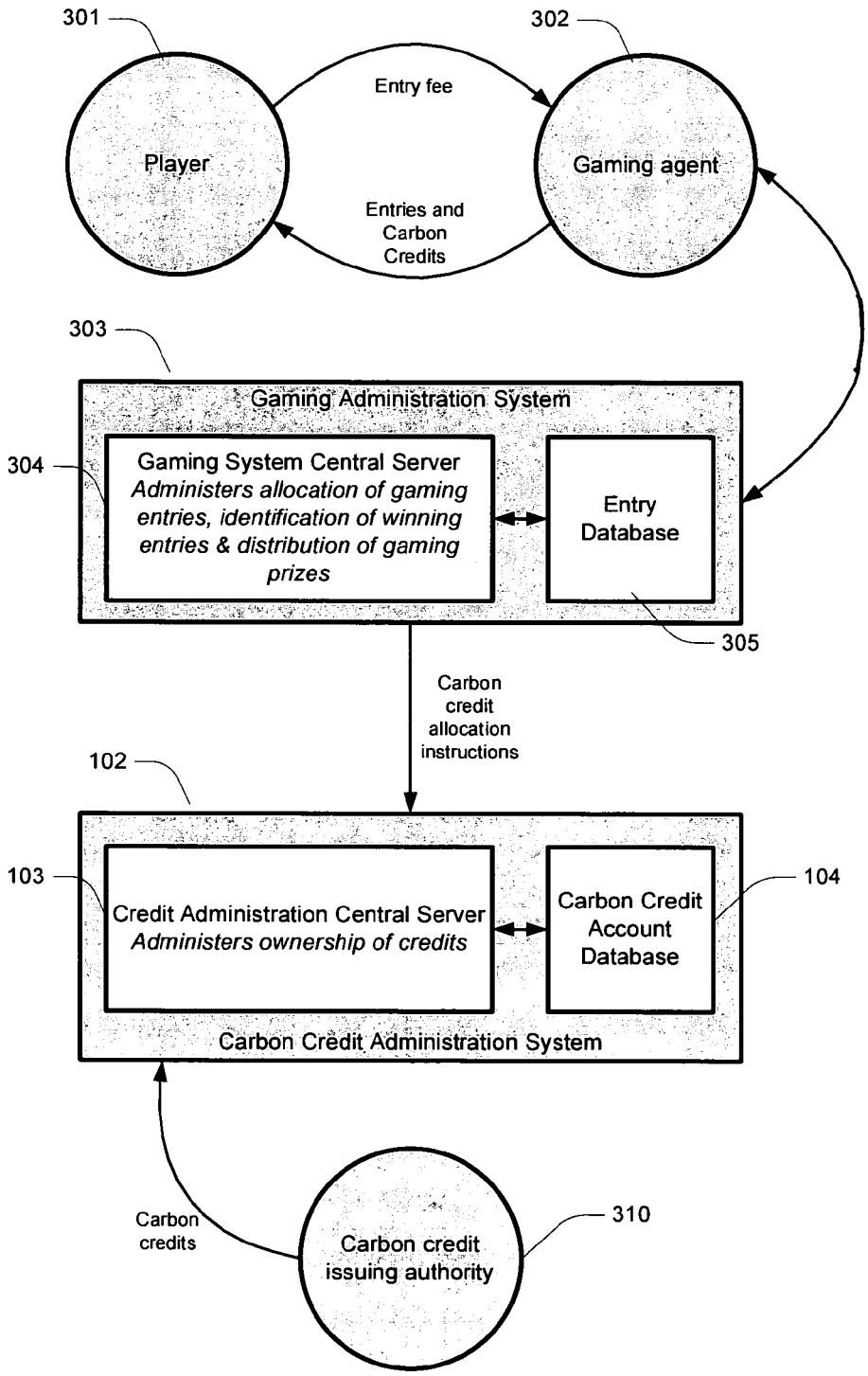
FIG. 3C illustrates gaming system and carbon credit management system according to one embodiment.

The example of FIG. 3B is generally similar to that of FIG. 3A, but shows a carbon credit issuing authority 310. Authority 310 provides carbon credits to system 303 (these may be internal credits for system 102, or external credits, depending on specifics of the arrangement). In the example of FIG. 3C, authority 310 alternately provides credits directly to system 102, these credits being initially allocated to an account associated with the gaming administration system. These credits are later allocated to consumer accounts (i.e. players' accounts) based on instructions from system 303.

Figure 3D:
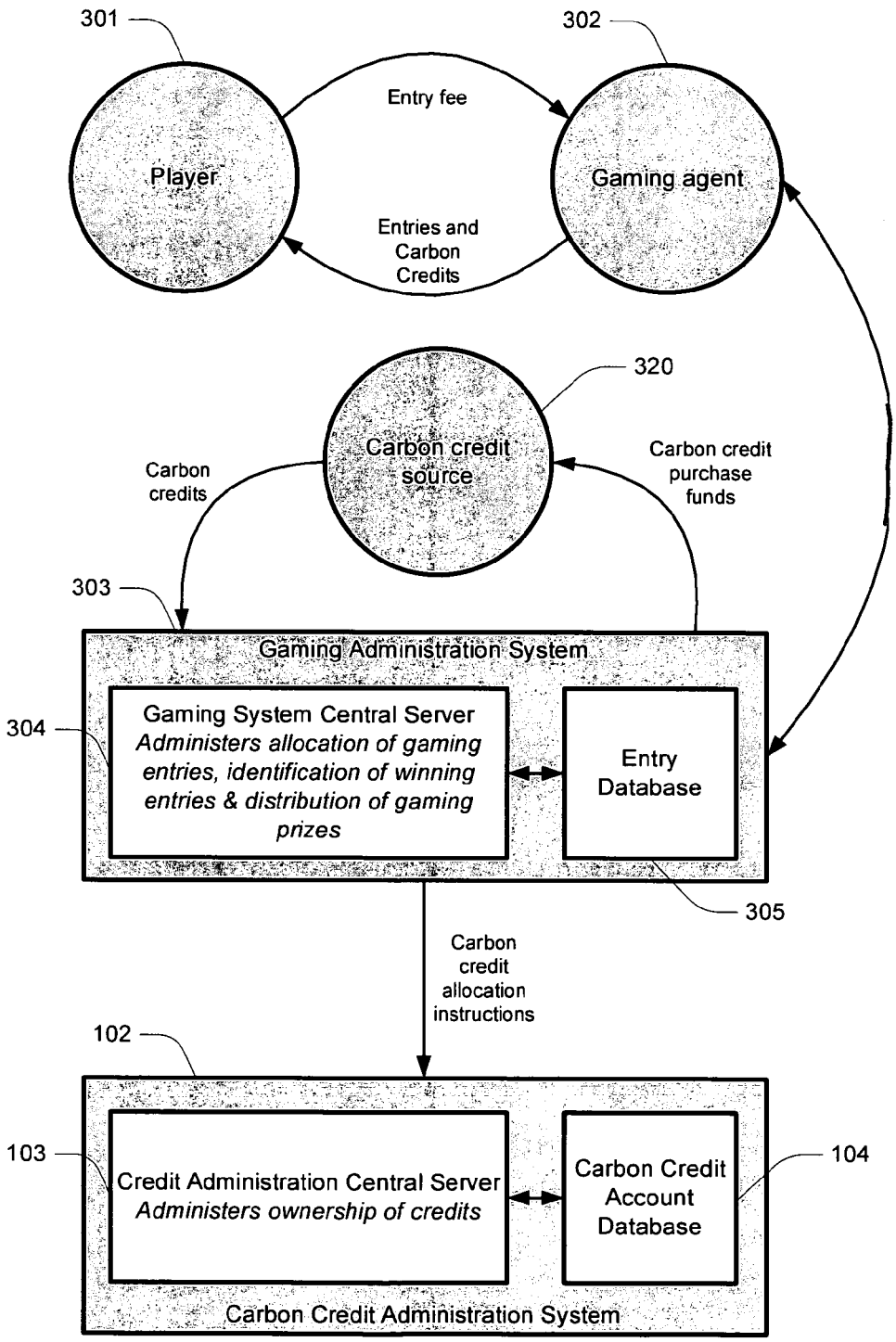
FIG. 3D illustrates gaming system and carbon credit management system according to one embodiment.
Figure 3E:
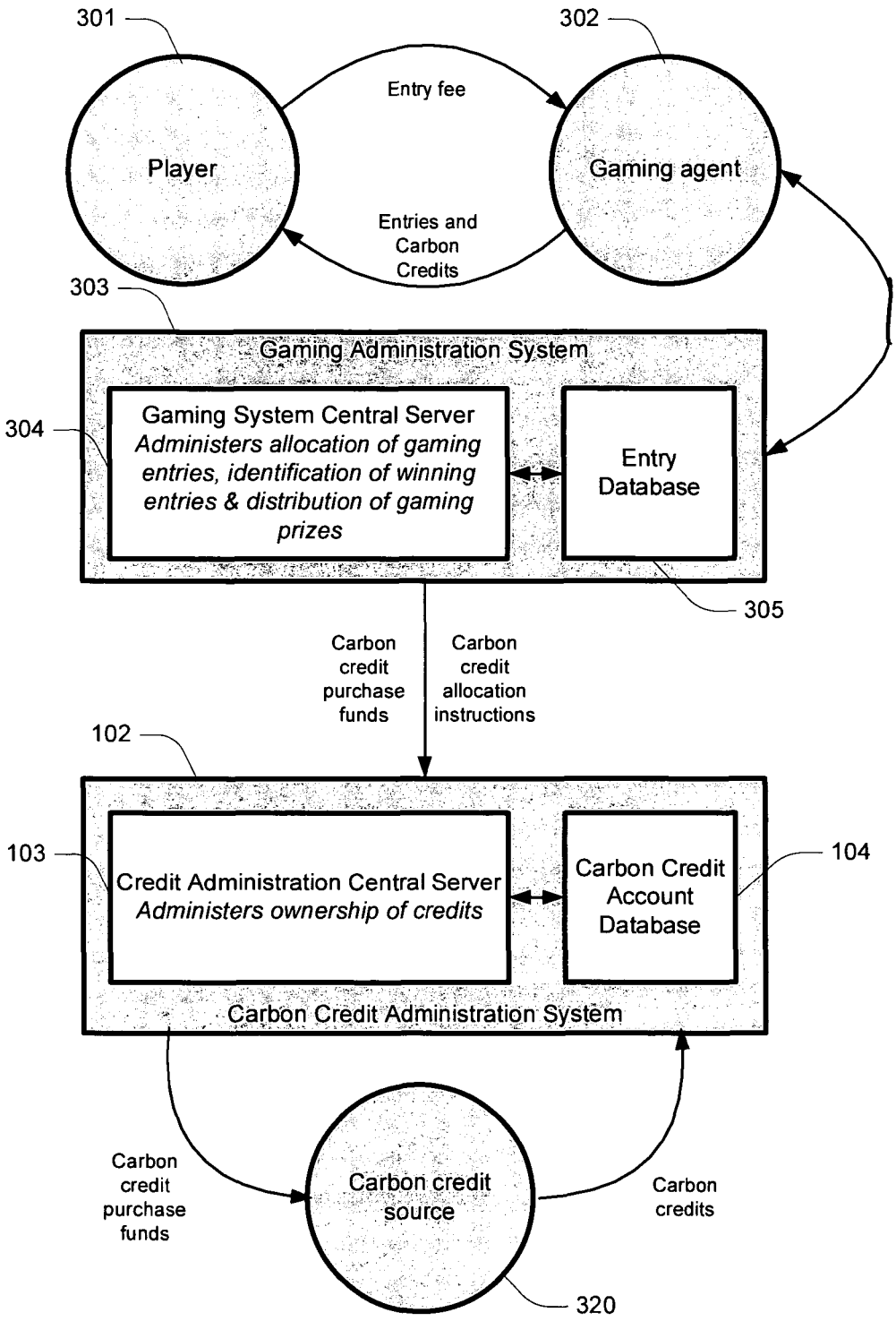
FIG. 3E illustrates gaming system and carbon credit management system according to one embodiment.

FIG. 3B and FIG. 3C are generally directed towards a situation where carbon credits are fed into system 303 or system 102, as opposed to being purchased (for example purchase of external credits for funding internal credits). This latter situation is illustrated in FIG. 3D and FIG. 3E, where carbon credits (typically external carbon credits) are purchased from a source 320. In the example of FIG. 3D, system 303 is responsible for this purchasing. In the example of FIG. 3E, system 102 is responsible, and funds are provided by system 303 for this purpose.

Carbon Credit Funding Models

Figure 4A:
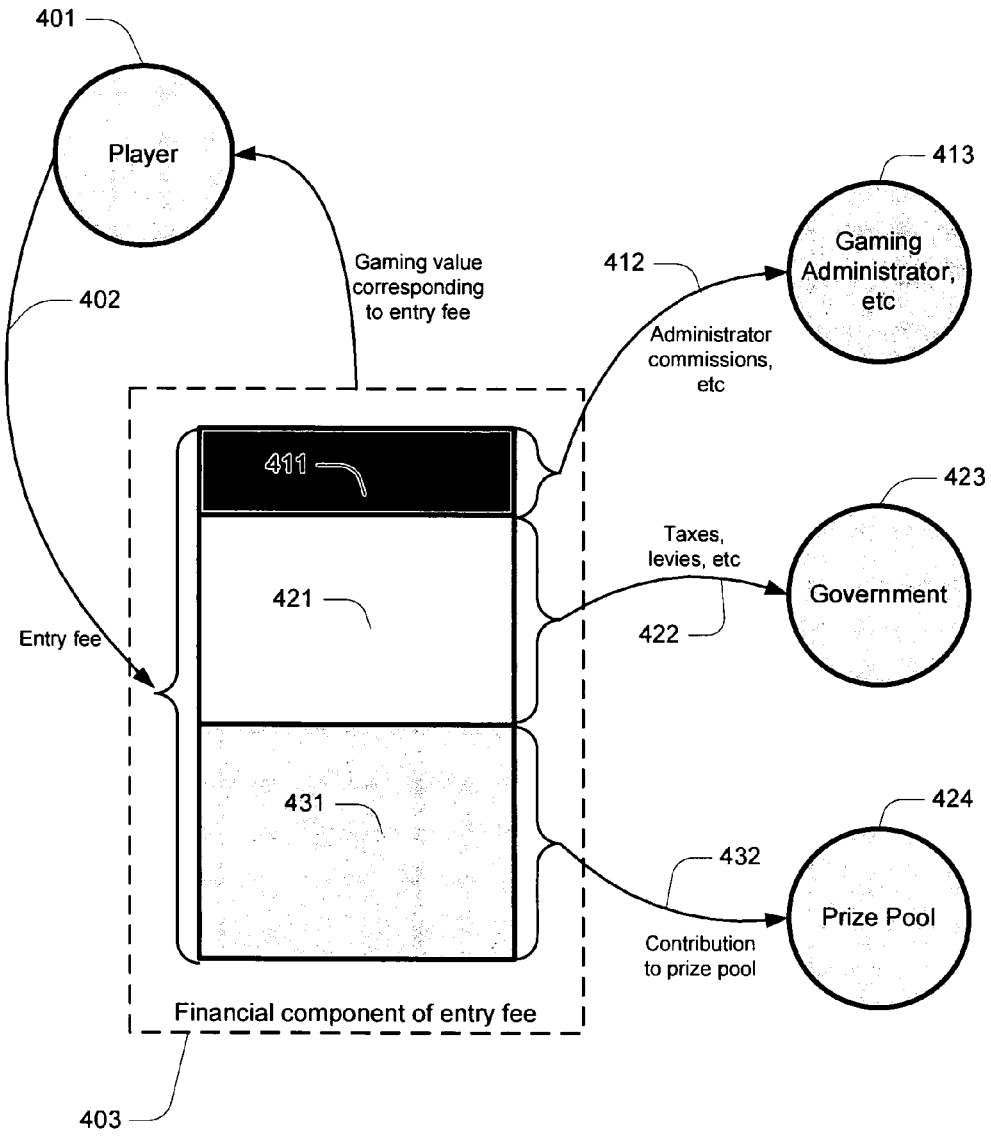
FIG. 4A (PRIOR ART)
FIG. 4A illustrates a prior art approach for managing a gaming activity.

As foreshadowed, the manner by which carbon credits are made available to distribution via such a lottery varied between embodiments. Some examples are considered below. As a starting point, FIG. 4A schematically illustrates the manner by which traditional lottery entry fees are attributable. In overview, a player 401 provides an entry fee 402, in the present example being a monetary entry fee. The financial component of this entry fee is designated by reference numeral 403, and is divided into multiple portions. It will be appreciate that this division is notional, and generally applied across a lottery operation over time as opposed to being applied to each individual entry fee.

Portion 411 includes administrator commissions and the like 412, and is attributable to a gaming administrator and similar parties 413. In essence, this portion provides gross income to parties involved in the carriage of the gaming activity.

Portion 421 includes taxes, levies, duties and the like 422, and is attributable to the government (or another similar party) 423. In essence, this portion provides allows the lottery to make a social contribution to the relevant jurisdictions, for example in the context of funding public works.

Portion 431 includes a prize pool contribution 432, and is attributable to a prize pool 433. In essence, this portion is used to partially or wholly fund prizes for the lottery. It will be appreciated that some lotteries make use of more complex arrangements for the funding of a prize pool, such as those disclosed in PCT/AU2007/000774. The present discussion is not intended to exclude such examples, but rather to provide a simple framework to conveniently illustrate other issues.

In exchange for the entry fee, player 401 receives gaming value corresponding to the entry fee. From one viewpoint, this gaming value corresponds to the financial value of the entry fee (i.e. a $10 entry fee purchases $10 worth of gaming value). From another viewpoint, the gaming value corresponds to the contribution to the prize pool (i.e. if a $10 entry fee results in a $4 contribution to the prize pool, this entry fee purchases $4 worth of gaming value). This latter approach is in some cases used to affect characteristics of entries allocated (for example the number of entries or the relative probability of winning)—this is discussed in PCT/AU2007/000774.

Figure 4B:
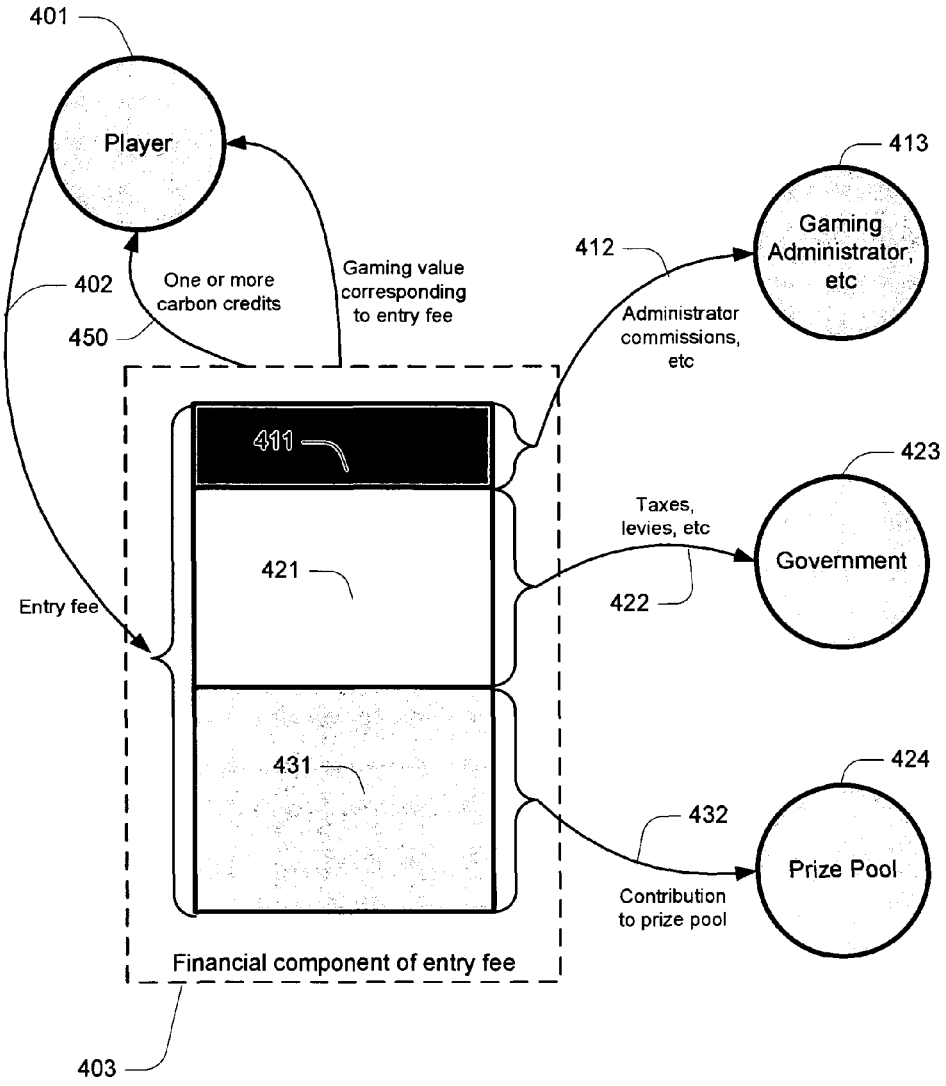
FIG. 4B illustrates an approach for managing a gaming activity according to one embodiment.
Figure 4C:
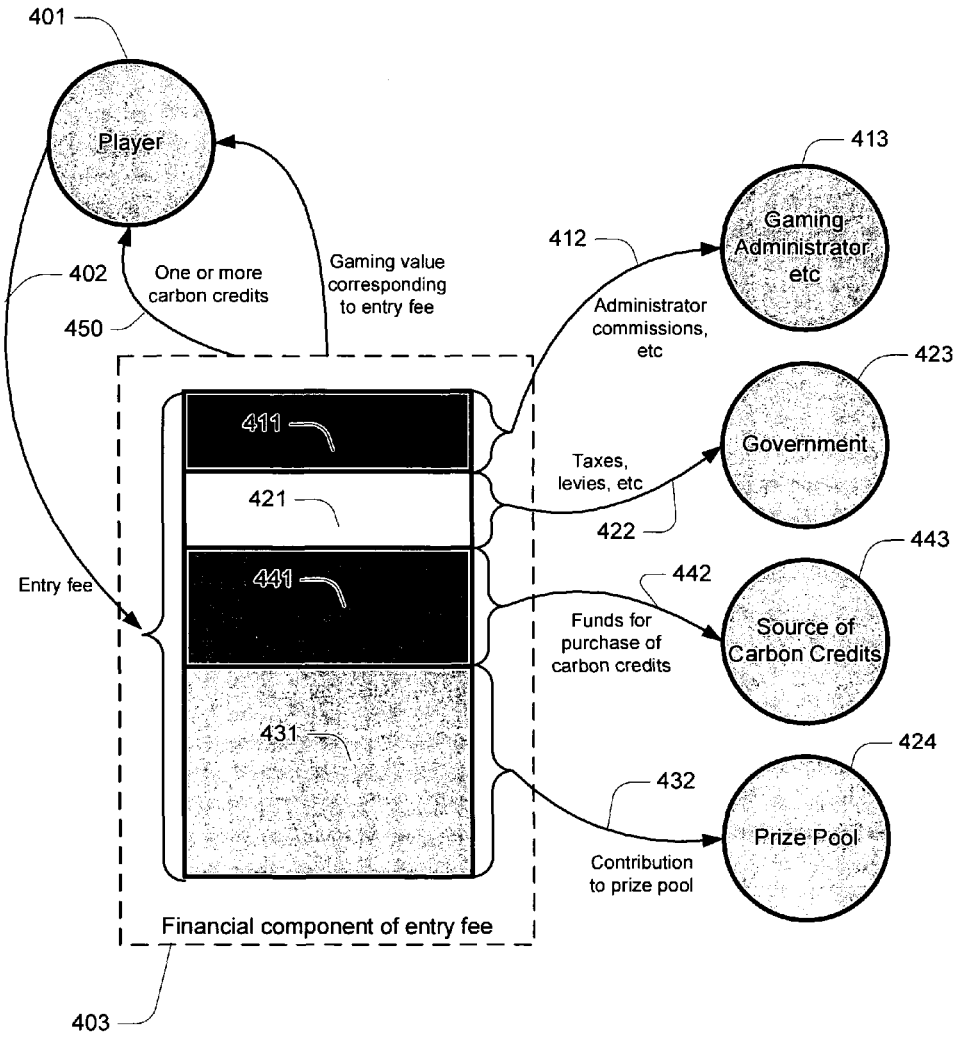
FIG. 4C illustrates an approach for managing a gaming activity according to one embodiment.
Figure 4D:
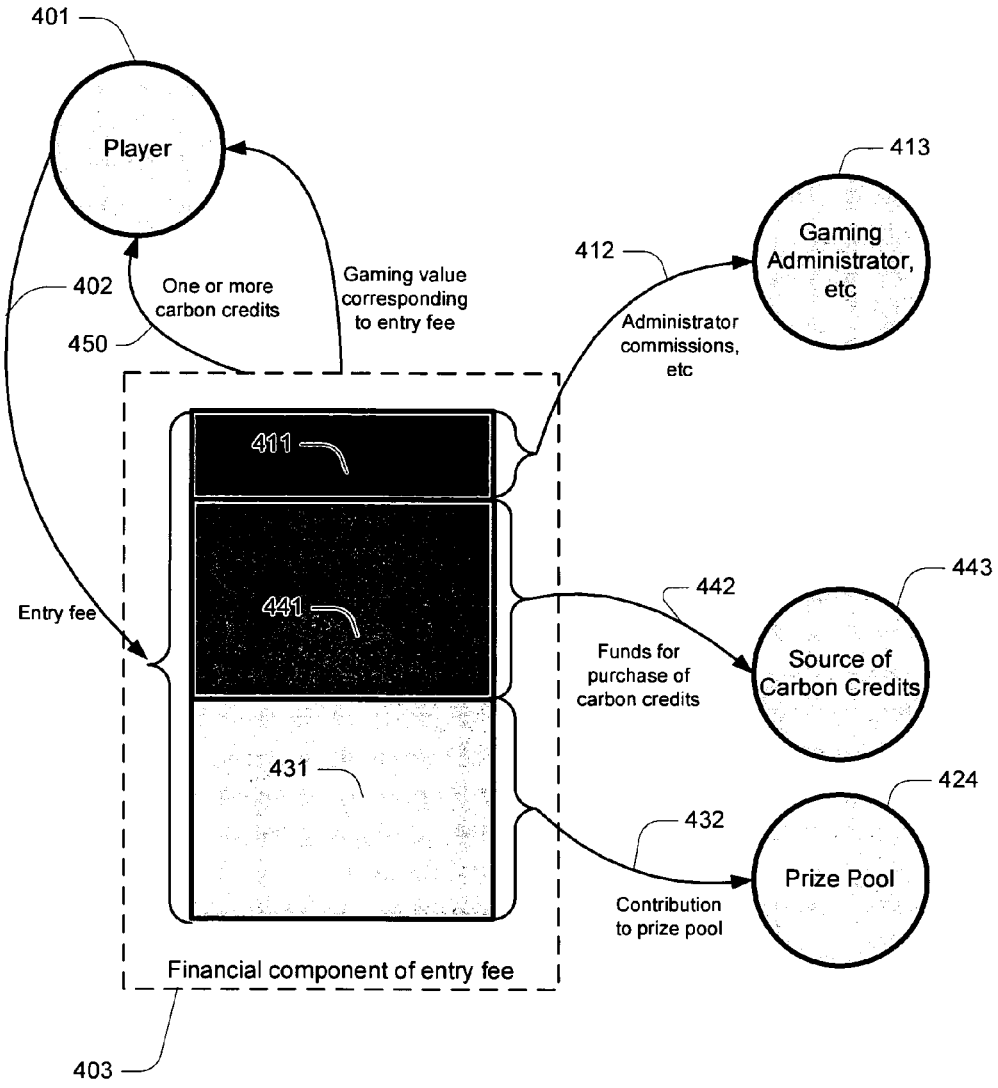
FIG. 4D illustrates an approach for managing a gaming activity according to one embodiment.

Referring now to FIG. 4B, FIG. 4C and FIG. 4D, in addition to receiving gaming value, the player receives one or more carbon credits 450. Taking the viewpoint that the gaming value corresponds to the financial value of the entry fee (i.e. a $10 entry fee purchases $10 worth of gaming value), and on the assumption that the one or more carbon credits have a financial value component (either viewed in terms of market price or intrinsic value to the player), the player receives a total value in assets in exchange for his/her entry fee that is greater than the quantum of the entry fee itself.

Of course, the additional value being provided to the player requires some for of funding source. In the example of FIG. 4B, the government (or another similar party) 423 provides to the lottery operator carbon credits in exchange for some or all of portion 421 (which includes taxes, levies, duties and the like 422). It may be that the government uses some or all of these taxes, levies, duties and the like 422 to fund environmental initiatives. However, this is by no means essential, as the mechanism of distributing carbon credits to the lottery operator may be viewed as useful in the sense of feeding a retail-level carbon market, and thereby causing business users to compete in that market for carbon credits (which may be necessary in the context of activity regulations imposed by the government). This differs from existing models, whereby governments are known to distribute carbon credits directly to those parties subject to activity regulation, thereby feeding only a wholesale-level market of business-to-business transfers.

In the example of FIG. 4C, the financial component 403 is divided into a further portion. Specifically, Portion 441 includes funds for the purchase of carbon credits 442 from a source of carbon credits 443. This source may include a non-government issuing authority, quasi-autonomous non-government organisation, government department, private enterprise that participates in abatement activities for the purpose of carbon credit generation, brokerage system (potentially included or provided in conjunction with system 102), abatement projects being undertaken by the lottery operator or an affiliate for the generation of carbon credits, and substantially any other source from which carbon credits might be obtained.

In some embodiments along the lines of FIG. 4C, portion 421 is reduced compared with a prior art situation following government approval on the understanding/condition that portion 441 would be directed to the purchase of carbon credits. In some cases portion 421 is reduced to zero, as shown in FIG. 4D.

Carbon credits 450 may be internal carbon credits (for example in the context of system 102) or external carbon credits, depending on specifics of the implementation.

The source of carbon credits in the context of these examples may include the like of a carbon credit retailer/wholesaler, a party to whom carbon credit are allocated by a government or non-government body, or a party that partakes in environmental initiatives for the purpose of carbon credit generation.

Some further numerical examples are provided in the following tables. These are exemplary only, and it will be appreciated that many other implementations are possible in practice.

EXAMPLE 1

| | | |
|---|---|---|
| Standard entry price | $10.00 | In this example, a $10 entry is exchanged for five chances in gaming activity. |
| Administrator fee | $1.50 | This amount is taken by the gaming administrator as net income in respect of each $10 standard entry sold . . . |
| Government portion | $4.00 | This amount is provided to the government in respect of each $10 standard entry sold. An agreement is reached whereby |

EXAMPLE 1-continued

| | | |
|---|---|---|
| | | the government issues the lottery operator with 1 carbon credit for each $1 received. The player receives 4 carbon credits with a $10 entry. |
| Prize component | $4.50 | This amount is allocated to a prize pool in respect of each $10 standard entry sold. |
| Consumer receives: | 5 chances in gaming activity ($10 in gaming value) plus 4 carbon credits | |

EXAMPLE 2

| | | |
|---|---|---|
| Standard entry price | $1.00 | In this example, a $1 entry is exchanged for a single chance in gaming activity. |
| Administrator fee | $0.15 | This amount is taken by the gaming administrator as net income in respect of each $1 standard entry sold . . . |
| Government portion | $0.10 | This amount is provided to the government in respect of each $1 standard entry sold. |
| Green portion | $0.40 | An agreement is reached whereby, in consideration for the lottery licence, the lottery operator will invest $0.40 out of every $1.00 gross income into approved environmental programs. These programs are selected such that, on average, they yield a value of at least 1 carbon credit (based on internal carbon credit definition) for each $0.20 invested. |
| Prize component | $0.35 | This amount is allocated to a prize pool in respect of each $1 standard entry sold. |
| Consumer receives: | 1 chance in gaming activity ($1 in gaming value) plus 2 carbon credits | |

EXAMPLE 3

| | | |
|---|---|---|
| Standard entry price | $1.00 | In this example, a $1 entry is exchanged for a single chance in gaming activity. |
| Administrator fee | $0.15 | This amount is taken by the gaming administrator as net income in respect of each $1 standard entry sold . . . |
| Government portion | $0.10 | This amount is provided to the government in respect of each $1 standard entry sold. |
| Green portion | $0.40 | An agreement is reached whereby, in consideration for the lottery licence, the lottery operator will invest $0.40 out of every $1.00 gross income into approved environmental programs. The government issues the gaming administrator with 1 carbon credit for each $0.20 invested. |
| Prize component | $0.35 | This amount is allocated to a prize pool in respect of each $1 standard entry sold. |
| Consumer receives: | 1 chance in gaming activity ($1 in gaming value) plus 2 carbon credits | |

EXAMPLE 4

| | | |
|---|---|---|
| Standard entry price | $1.00 | In this example, a $1 entry is exchanged for a single chance in gaming activity. |
| Administrator fee | $0.15 | This amount is taken by the gaming administrator as net income in respect of each $1 standard entry sold . . . |
| Government portion | $0.00 | The government does not take a cut in this example. |
| Green portion | $0.40 | An agreement is reached whereby, in consideration for the lottery licence, the lottery operator will invest $0.40 towards the purchase of carbon credits from a source of carbon credits. The market price (wholesale or retail) varies over time, and the client is allocated a $0.40 share in carbon credits based on the market value at the time of allocation. |
| Prize component | $0.45 | This amount is allocated to a prize pool in respect of each $1 standard entry sold. |
| Consumer receives: | 1 chance in gaming activity ($1 in gaming value) plus $0.40 share in carbon credits based on the market value at the time of allocation. | |

EXAMPLE 5

| | | |
|---|---|---|
| Standard entry price | $5.00 | In this example, a $5 entry is exchanged for a single chance in gaming activity. |
| Administrator fee | $0.50 | This amount is taken by the gaming administrator as net income in respect of each $5 standard entry sold . . . |
| Government portion | $0.50 | This amount is provided to the government in respect of each $5 standard entry sold. |
| Carbon portion | $2.00 | An agreement is reached whereby, in consideration for the lottery licence, the lottery operator will use $2 to purchase carbon credits from accredited sources. This is implemented |

EXAMPLE 5-continued

| | | |
|---|---|---|
| | | such that, on average, they yield a value of at least 1 carbon credit (based on internal carbon credit definition) for each $2 outlay. |
| Prize component | $2.00 | This amount is allocated to a prize pool in respect of each $5 standard entry sold. |
| Consumer receives: | 1 chance in gaming activity ($5 in gaming value) plus 1 carbon credit | |

IT Implementation of Gaming Activity

In some embodiments, gaming activities are implemented using various combinations of hardware and software. Some of these are considered below.

Figure 5A:
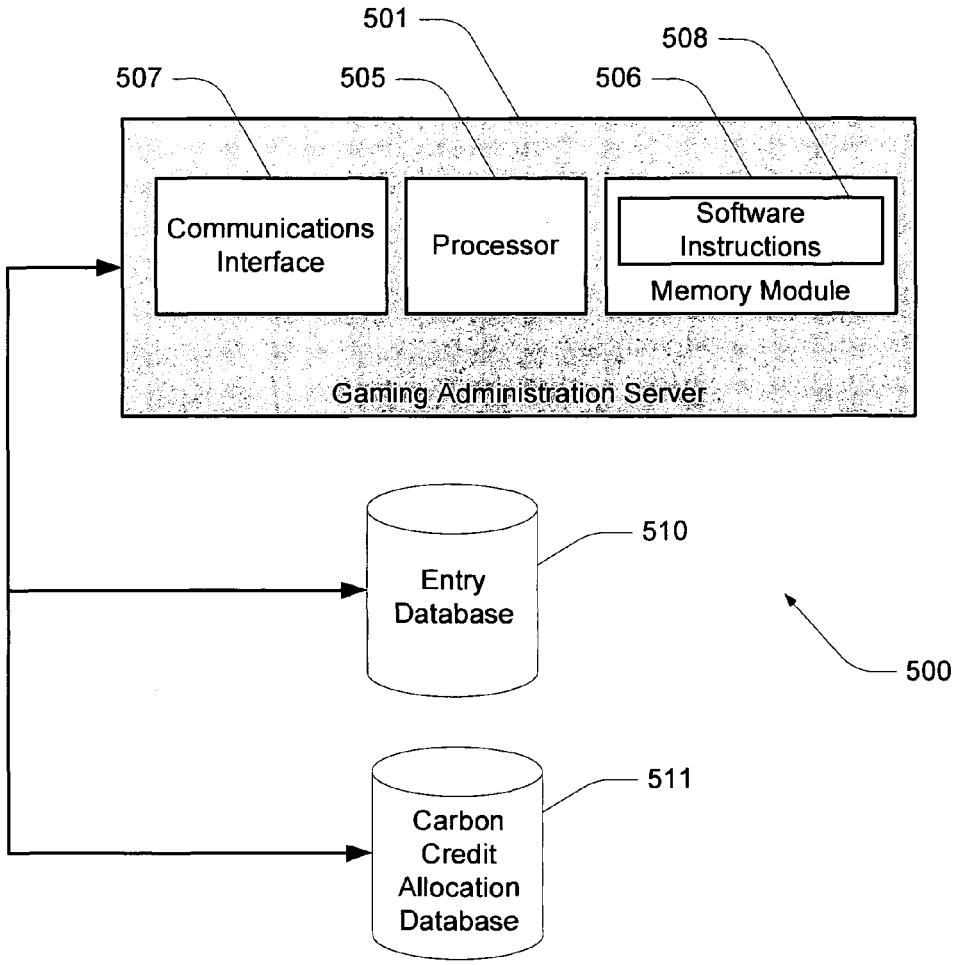
FIG. 5A illustrates an IT infrastructure according to one embodiment.

FIG. 5A illustrates a system for providing a gaming activity, in the form of system 500. System 500 includes a gaming administration server 501. This gaming administration server includes a processor 505 coupled to a memory module 506 and a communications interface 507.

Memory module 506 is configured for maintaining software instructions 506 which, when executed on processor 505, allow server 501 to perform various methods, including but not limited to one or more of the methods described herein, including (but not limited to) method associated with the allocation of entries, distribution of prizes, and implementation of a carbon credit allocation protocol.

The term "communications interface" or "interface" should be read broadly to include any component or group of components including one or more of a network interface (such as an Ethernet interface, or other wired/wireless network interface), modem, other interfaces configured to allow communication between server 501 and another processing platform, ports (such as serial or parallel ports) for receiving data from or providing data to input/output devices such as keyboards, scanners and printers.

As illustrated, server 501 is in communication with an entry database 510 and a carbon credit database 511. Although, in the context of the present illustrations, these databases are shown as being a single discrete component, in alternate embodiments they is defined by a plurality of distributed components, optionally including memory modules of one or more servers such as server 501. In some embodiments, the carbon credit database 511 is provided via a carbon credit administration server (not shown), and server 501 communicates with that carbon credit administration server for the prupose of providing data intended for database 511. For example, server 501 communicates data indicative of the allocation of one or more carbon credits to a particular account.

For some embodiments, database 511 is representative of a carbon credit administration network, including a plurality of intercommunicating servers and/or databases.

Figure 5B:
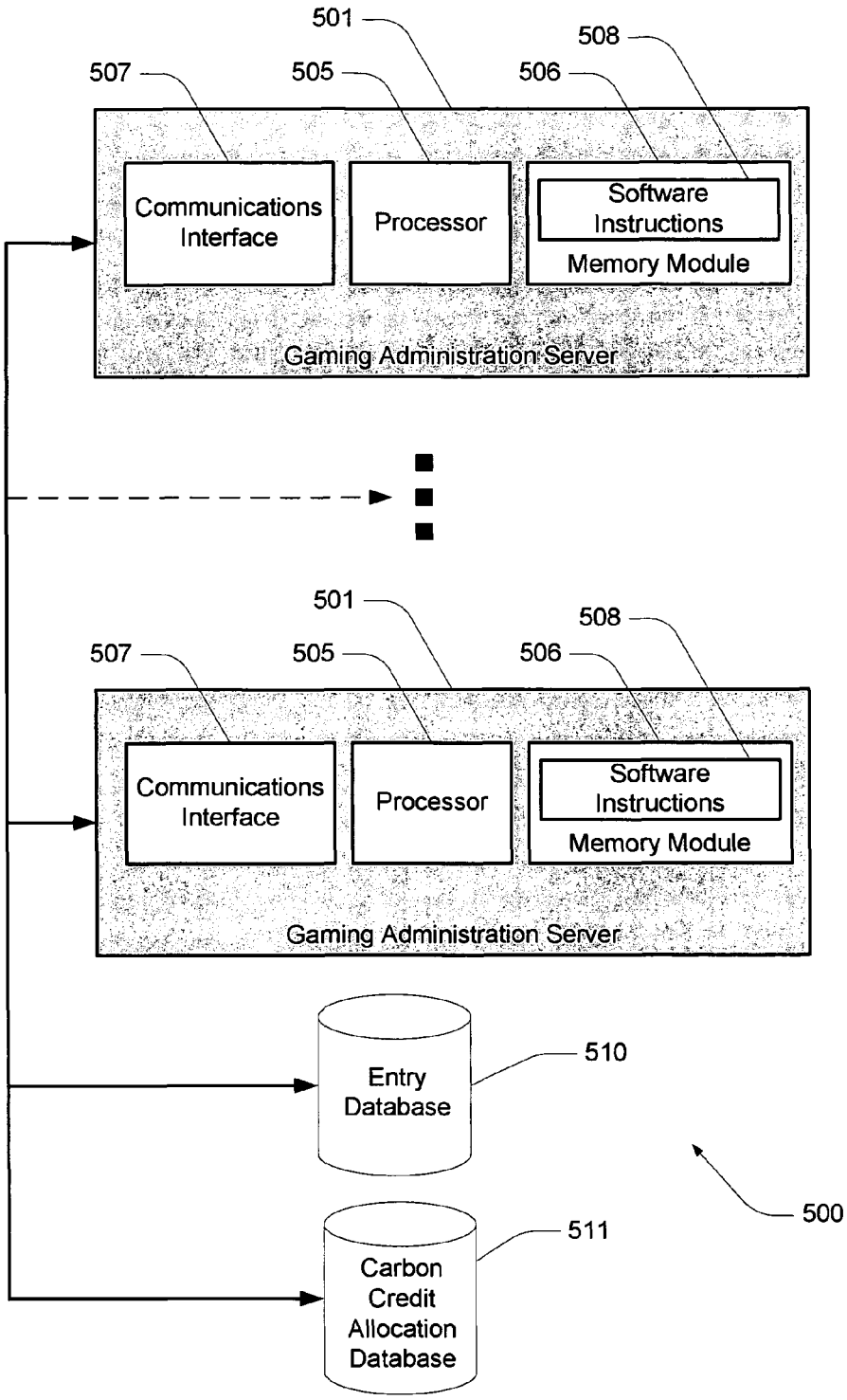
FIG. 5B illustrates an IT infrastructure according to one embodiment.

In some embodiments, such as that of FIG. 5B, a plurality of like or similar servers 501 are coupled to a common database 510 and database 511. For example, servers 501 are provided at distributed locations, with a database 511 and 512 respectively provided at centralised locations.

Database 510 maintains data indicative of entry transactions, which includes, in various embodiments, one or more of the following aspects of data:

Data indicative of a received entry fee. This includes data indicative of the value of entry fee, and optionally data indicative of a location at which funds corresponding to that entry fee are stored (for example, a bank account), and/or data indicative of a manner of payment used to provide the entry fee.

Data indicative of a risk profile associated with the entry fee, in cases where approaches such as those of PCT/AU2007/000774 are used.

Data indicative of a player who provided the entry fee. In some embodiments, a player is assigned an identifier, which is used by that player for gaming related transactions. For example, in one embodiment this identifier is carried by a loyalty card, for example in the form of a barcode or RFID tag.

Data indicative of one or more entries allocated to the player in exchange for the entry fee. In some embodiments each entry is provided with a unique entry identifier (which is optionally used for winning entry determinations in the context of a lottery or raffle type game). In some embodiments the one or more entries allocated to a player in respect of a given entry fee are provided a common identifier—for example, the player is provided a single "ticket", which may be virtual or physical, carrying a ticket identifier. Entry identifiers and/or ticket identifiers are later used by the relevant players to allow the redemption of prizes and/or refunds, as discussed further below.

Data indicative of a particular gaming activity to which the entry fee and/or allocated entries relate.

In some embodiments, data indicative of carbon credit allocations. In one embodiment, data indicative of carbon credit allocation is initially provided to database 510, and a separate process executing on a server coupled to database 510 is responsible for extracting that data and batching it to database 511.

Database 510 maintains data indicative of the allocation of carbon credits. For example, database 511 maintains data indicative of a plurality of consumer accounts, and is responsible to data received from trusted machines for increasing/decreasing the level of credit in particular consumer amounts, creating new consumer accounts, and so on.

Various aspects of this data are received via interface 507 and/or defined by server 501 (for instance, in response to data received via interface 507). In some embodiments the allocation of entries occurs at server 501, whilst in other embodiments the allocation of entries occurs at a remote location, for example a retailer terminal at a location where entries are sold to players.

Figure 5C:
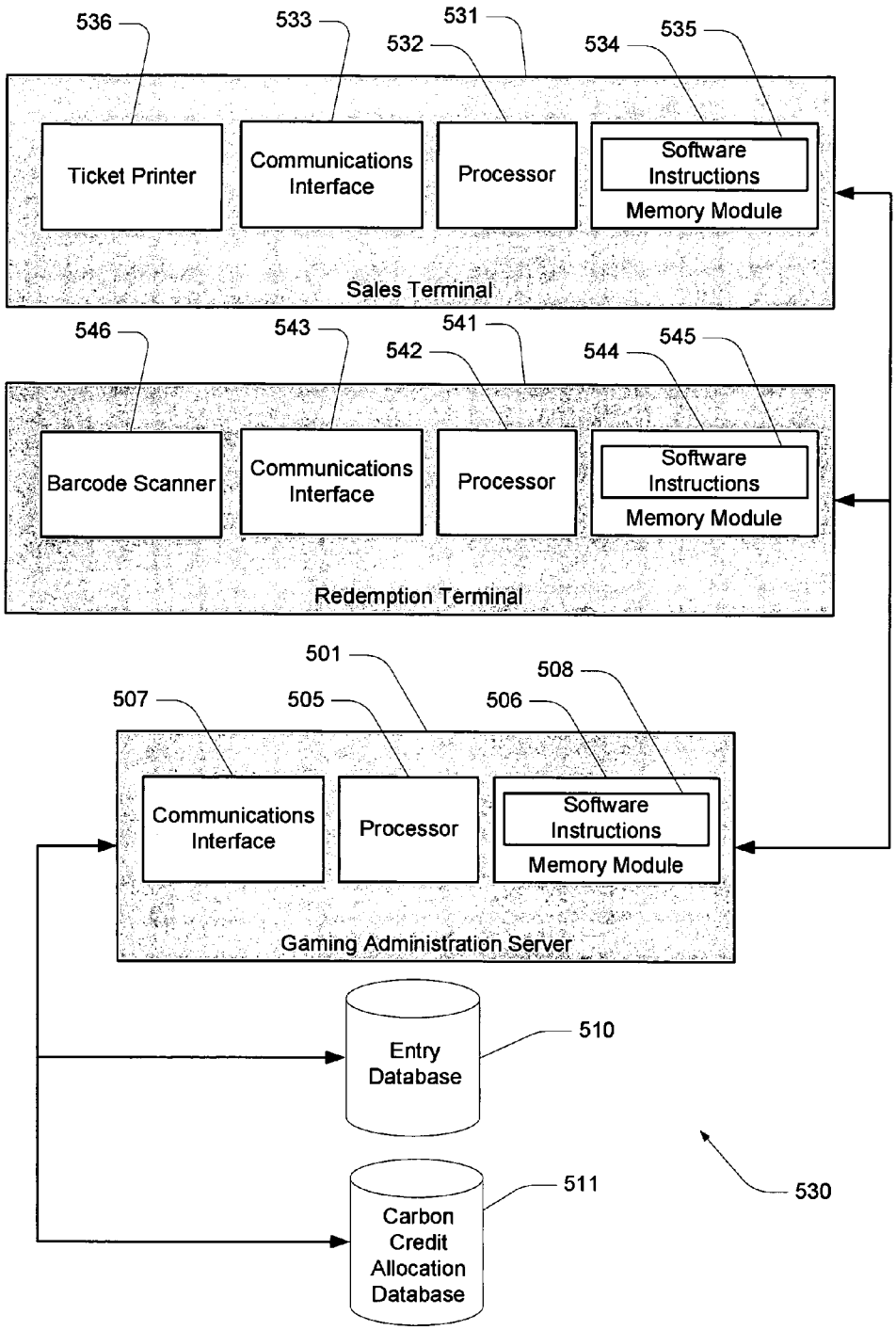
FIG. 5C illustrates an IT infrastructure according to one embodiment.
Figure 5D:
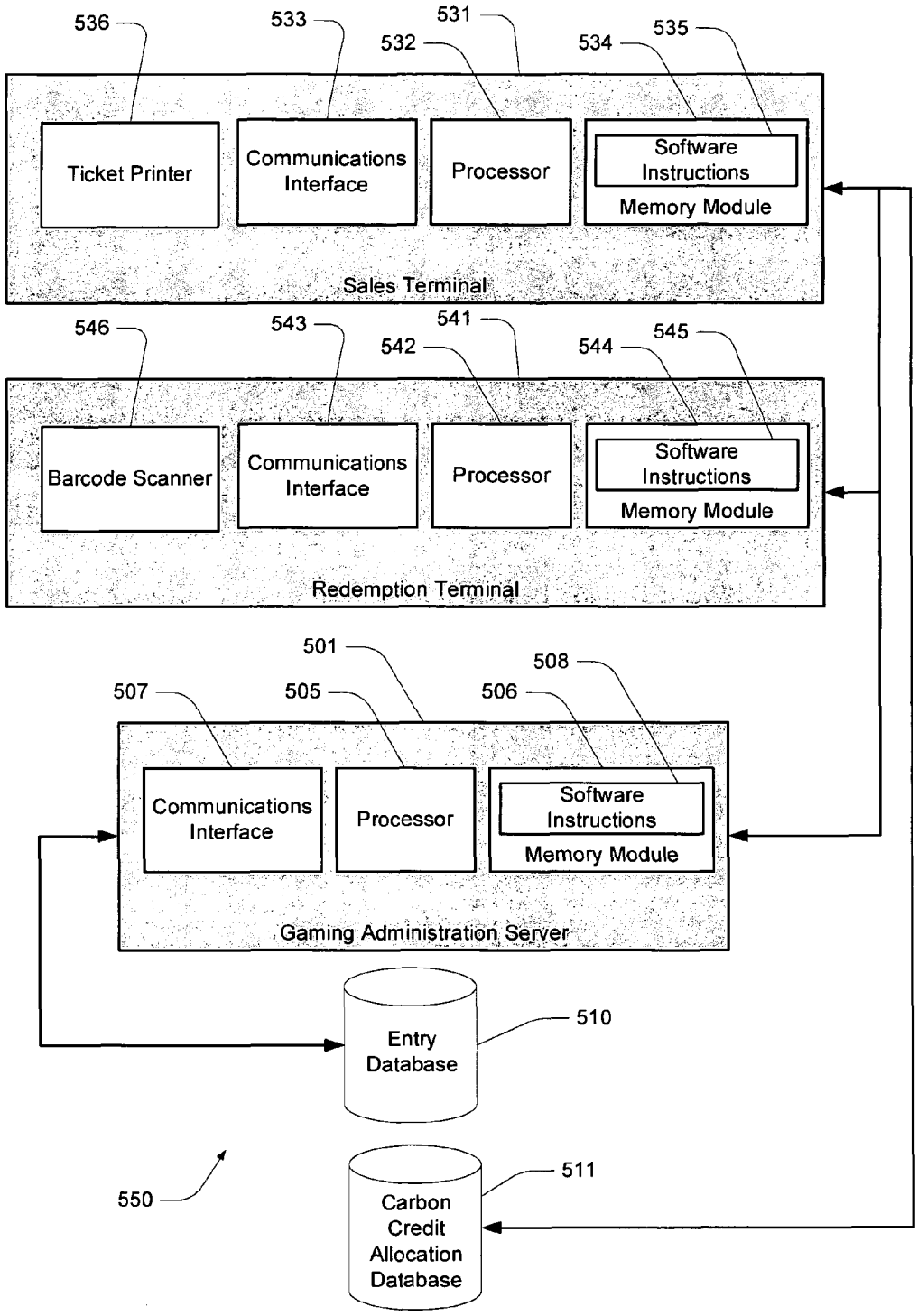
FIG. 5D illustrates an IT infrastructure according to one embodiment.

FIG. 5C and FIG. 5D illustrates embodiments 530 and 550 where a server 501 is coupled to a sales terminal 531 and redemption terminal 541. In some embodiments these are integrated into a single terminal.

As illustrated, terminal 531 includes a processor 532, communications interface 533 and memory module 534 (which maintains software instructions 535). A ticket printer 536 is also coupled to processor 532.

In overview, a player interacts with terminal 532 to purchase one or more entries in relation to a gaming activity. In some embodiments this is a direct interaction, whereas in other embodiments it is an indirect interaction whereby a terminal operator interacts with terminal 532 on behalf of the player. The player provides information regarding the gaming activity in which entries are to be purchased and so on. The player also provides an entry fee, optionally in the form of cash or electronic/card payment means. The entry fee is directly or indirectly transferred to an account stipulated by the gaming operator either immediately or at the end of a specified period (daily, for instance). The allocation of entries is, in some cases, based on a process performed at terminal 531 and, in other cases, based on a process performed at terminal 501 based on data provided by terminal 531. In the present example, data indicative of the entries is printed to a ticket (which might include a receipt) via printer 536. In some embodiments this ticket carries a ticket identifier and/or one or more entry identifiers corresponding to the allocated entries. In the present example, this information is derivable from a barcode (such as a 2-dimensional or 3-dimensional barcode) printed on the ticket. In some embodiments the ticket additionally includes data indicative of the allocation of carbon credits (although this may be provided on a separate ticket printed by printer 536). Terminal 532 provides communications over a network such that pertinent data is centrally collated in databases 510 and 511. In the case of FIG. 5C data is provided to database 511 via server 501, whilst in the example of FIG. 5D terminal 532 communicates directly with database 511 (noting that database 511 is in some embodiments representative of a broader carbon credit administration network).

As illustrated, terminal 541 includes a processor 542, communications interface 543 and memory module 544 (which maintains software instructions 545). A barcode scanner 546 is also coupled to processor 542. In overview, to redeem one or more entries, a player presents a ticket carrying a barcode from which the relevant identifier (or identifiers) is derivable by scanner 546. Scanner 546 then performs a query process to determine whether the read barcode is indicative of any winning entries. This, in some cases, requires communications with server 501. Prizes and/or refunds are provided to the player where appropriate. In some cases these are provided by cash, and in some cases by way of a further ticket or other indication of entitlement that is redeemable for cash or cheque either upon presentation, or at some predetermined future point in time. In further cases, the player nominates a location to which the prize/refund should be delivered, such as a physical address or bank account. In some cases the player arranges for the prize/refund to be credited to a specified bank/credit card account.

In some embodiments, entry redemption is automated. For example, a player is invited to create a user account, this account including details of a bank account to which prizes/refunds are to be credited, and this crediting occurs automatically.

In some embodiments some or all of the general functionalities of either or both of terminal 531 and 541 are made available to a player via a personal computing platform, such as a desktop computer, laptop computer, cellular telephone, PDA, gaming console, or other platform. In some such embodiments, players access a website over the Internet to purchase entries, for example via a selection interface provided by a web-page viewable through a web-browser application, and providing entry fees by way of an online payment procedure. In other embodiments, players download proprietary software as an alternative to a browser-based approach.

In some embodiments, entries are sold both via online approaches (for example via a website accessible over the Internet) and in-store approaches (for example at a retail location having a sales terminal and/or redemption terminal). In some cases, different rules apply for entries sold online as opposed to entries sold in-store. For example, in one embodiment, in-store entries are sold on the basis of a first minimum spend level, whist online entries are sold on the basis of a second minimum spend level which is lower than the first level. In some cases in-store entries can only be purchased in exchange for entry fees that are integral multiples of the minimum spend level or another predefined value, although such restrictions do not necessarily apply online.

Figure 6A:
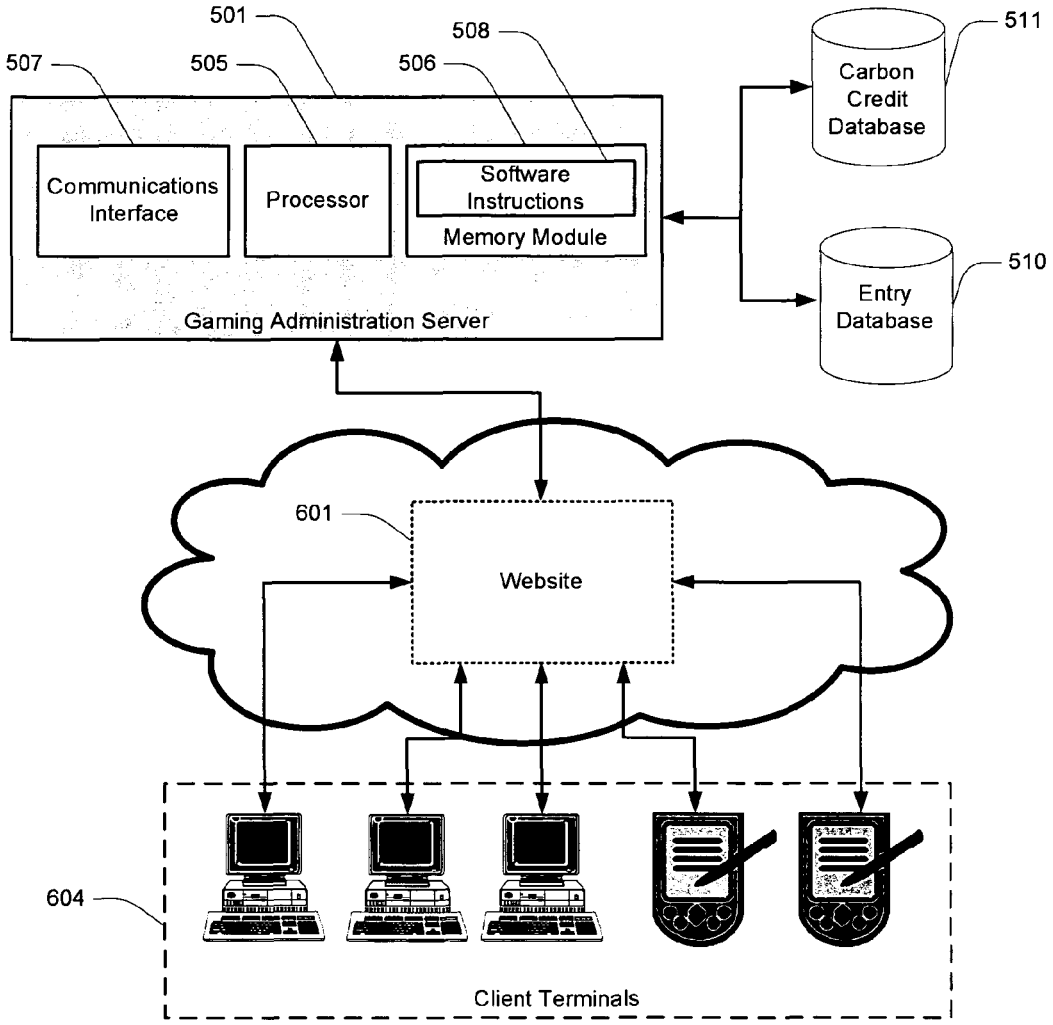
FIG. 6A illustrates an IT infrastructure according to one embodiment.
Figure 6B:
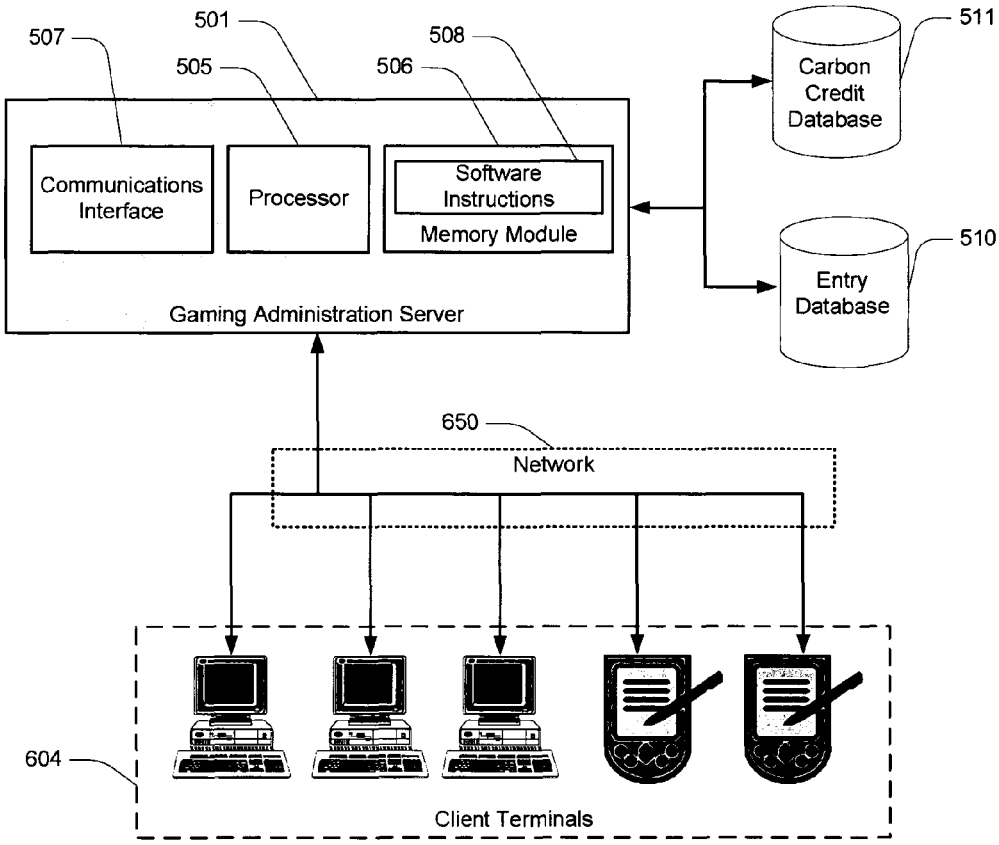
FIG. 6B illustrates an IT infrastructure according to one embodiment.

FIG. 6A and FIG. 6B illustrate two approaches for interfacing gaming administration server 501 with a plurality of client terminals 604 (optionally including the likes of players' personal terminals, and terminals provided at entry retail venues). In some embodiments a combination of the two approaches is used.

The approach of FIG. 6A is to provide a website 601 on the Internet for interfacing the client terminals with the administration server. The approach of FIG. 6B is to provide a connection, such as a VPN connection, over the Internet or another network (such as a LAN or WAN) 650 for interfacing the client terminals with the administration server.

Unless specifically stated otherwise, it should be appreciated that throughout the specification terms such as "processing," "computing," "calculating," "determining", analyzing" or the like, in some embodiments refer to the action and/or processes of a computer or computing system, or similar electronic computing device, that manipulate and/or transform data represented as physical, such as electronic, quantities into other data similarly represented as physical quantities.

In a similar manner, the term "processor" may refer to any device or portion of a device that processes electronic data, e.g., from registers and/or memory to transform that electronic data into other electronic data that, e.g., may be stored in registers and/or memory. A "computer" or a "computing machine" or a "computing platform" may include one or more processors.

The methodologies described herein are, in some embodiments, performable by one or more processors that accept computer-readable (also called machine-readable) code containing a set of instructions that, when executed by one or more of the processors, carry out at least one of the methods described herein, or a variation on at least one of the methods described herein. Any processor capable of executing a set of instructions (sequential or otherwise) that specify actions to be taken should be included. Thus, one example is a typical processing system that includes one or more processors. Each processor may include one or more of a CPU, a graphics processing unit, and a programmable DSP unit. The processing system further may include a memory subsystem including main RAM and/or a static RAM, and/or ROM. A bus subsystem may be included for communicating between the components. The processing system further may be a distributed processing system with processors coupled by a network. If the processing system requires a display, such a display may be included, e.g., an liquid crystal display (LCD) or a cathode ray tube (CRT) display. If manual data entry is required, the processing system also includes an input device such as one or more of an alphanumeric input unit such as a keyboard, a pointing control device such as a mouse, and so forth. The term memory unit as used herein, if clear from the context and unless explicitly stated otherwise, also encompasses a storage system such as a disk drive unit. The processing system in some configurations may include a sound output device, and a network interface device. The memory subsystem thus includes a computer-readable carrier medium that carries computer-readable code (e.g., software) including a set of instructions to cause performing, when executed by one or more processors, one of more of the methods described herein. Note that when the method includes several elements, e.g., several steps, no ordering of such elements is implied, unless specifically stated. The software may reside in the hard disk, or may also reside, completely or at least partially, within the RAM and/or within the processor during execution thereof by the computer system. Thus, the memory and the processor also constitute computer-readable carrier medium carrying computer-readable code.

Furthermore, a computer-readable carrier medium may form, or be includes in a computer program product.

In alternative embodiments, the one or more processors operate as a standalone device or may be connected, e.g., networked to other processor(s), in a networked deployment, the one or more processors may operate in the capacity of a server or a user machine in server-user network environment, or as a peer machine in a peer-to-peer or distributed network environment. The one or more processors may form a personal computer (PC), a tablet PC, a set-top box (STB), a Personal Digital Assistant (PDA), a cellular telephone, a web appliance, a network router, switch or bridge, or any machine capable of executing a set of instructions (sequential or otherwise) that specify actions to be taken by that machine.

Note that while some diagrams only show a single processor and a single memory that carries the computer-readable code, those in the art will understand that many of the components described above are included, but not explicitly shown or described in order not to obscure the inventive aspect. For example, while only a single machine is illustrated, the term "machine" or "device" shall also be taken to include any collection of machines that individually or jointly execute a set (or multiple sets) of instructions to perform any one or more of the methodologies discussed herein.

At least one embodiment of each of the methods described herein is in the form of a computer-readable carrier medium carrying a set of instructions (such as a computer program) that are for execution on one or more processors, (such as one or more processors that are part of an information system). Thus, as will be appreciated by those skilled in the art, embodiments of the present invention may be embodied as a method, an apparatus such as a special purpose apparatus, an apparatus such as a data processing system, or a computer-readable carrier medium (such as a computer program product). The computer-readable carrier medium carries computer readable code including a set of instructions that when executed on one or more processors cause the processor or processors to implement a method. Accordingly, aspects of the present invention may take the form of a method, an entirely hardware embodiment, an entirely software embodiment or an embodiment combining software and hardware aspects. Furthermore, the present invention may take the form of carrier medium (such as a computer program product on a computer-readable storage medium) carrying computer-readable program code embodied in the medium.

The software may further be transmitted or received over a network via a network interface device or other communications interface. While the carrier medium is shown in an exemplary embodiment to be a single medium, the term "carrier medium" should be taken to include a single medium or multiple media (such as a centralized or distributed database, and/or associated caches and servers) that store the one or more sets of instructions. The term "carrier medium" shall also be taken to include any medium that is capable of storing, encoding or carrying a set of instructions for execution by one or more of the processors and that cause the one or more processors to perform any one or more of the methodologies of the present invention. A carrier medium may take many forms, including but not limited to, non-volatile media, volatile media, and transmission media. Non-volatile media includes, for example, optical, magnetic disks, and magneto-optical disks. Volatile media includes dynamic memory, such as main memory. Transmission media includes coaxial cables, copper wire and fiber optics, including the wires that comprise a bus subsystem. Transmission media also may also take the form of acoustic or light waves, such as those generated during radio wave and infrared data communications. For example, the term "carrier medium" shall accordingly be taken to included, but not be limited to, solid-state memories, a computer product embodied in optical and magnetic media, a medium bearing a propagated signal detectable by at least one processor of one or more processors and representing a set of instructions that when executed implement a method, a carrier wave bearing a propagated signal detectable by at least one processor of the one or more processors and representing the set of instructions a propagated signal and representing the set of instructions, and a transmission medium in a network bearing a propagated signal detectable by at least one processor of the one or more processors and representing the set of instructions.

It will be understood that the steps of methods discussed are performed in one embodiment by an appropriate processor (or processors) of a processing system (such as a computer) executing instructions (computer-readable code) stored in storage. It will also be understood that the invention is not limited to any particular implementation or programming technique and that the invention may be implemented using any appropriate techniques for implementing the functionality described herein. The invention is not limited to any particular programming language or operating system.

CONCLUSIONS

Although the invention has been described with reference to specific examples, it will be appreciated by those skilled in the art that the invention may be embodied in many other forms. While there has been described what are believed to be the preferred embodiments of the invention, those skilled in the art will recognize that other and further modifications may be made thereto without departing from the spirit of the invention, and it is intended to claim all such changes and modifications as falling within the scope of the invention. For example, any formulae given above are merely representative of procedures that may be used. Functionality may be added or deleted from the block diagrams and operations may be interchanged among functional blocks. Steps may be added to or deleted from methods described herein whilst remaining within the scope of the present invention.

The invention claimed is:

1. A data processing method including the steps of:

receiving, in relation to a gaming activity wherein a plurality of players provide respective entry fees, entry data for a given player;

processing the entry data on the basis of an entry allocation protocol, and based on that processing, determining a level of gaming value for allocation to the player in respect of the gaming activity;

processing the entry data on the basis of a carbon credit allocation protocol, and based on that processing determining a level of carbon credit value for allocation to the player, wherein the level of carbon credit value has an associated environmental utilitarian value aspect and an associated financial value aspect; and providing signals for effecting the allocation to the player of the determined level of gaming value and the determined level of carbon credit value;

wherein outcome data is defined in respect of the gaming activity for allowing for the identification of one or more winning entries, and wherein the processing of the entry data on the basis of the carbon credit allocation protocol is independent of the outcome data.

2. A method according to claim 1 wherein the level of carbon credit value corresponds to a specified number of one or more carbon credits or a specified value of carbon credits.

3. A method according to claim 1 wherein the signals include data indicative of an instruction to increase the level of carbon credit value in an account associated with the player by the determined level of carbon credit value.

4. A method according to claim 1 wherein the signals include data indicative of an instruction to generate receipt data for the player in respect of the determined level of carbon credit value.

5. A method according to claim 1 including the steps of receiving outcome data for the gaming activity, wherein the outcome data allows for the identification of one or more winning entries for the gaming activity; and providing signals for effecting, in accordance with a predetermined prize distribution protocol, the allocation of prizes to the players to whom winning entries were allocated.

6. A method according to claim 1 wherein the level of carbon credit value has a defined utilitarian value and a variable financial value.

7. An information management system including:

a component configured to communicate with an information source that maintains data indicative of an entry allocation protocol in relation to a gaming activity wherein a plurality of players provide respective entry fees, wherein the entry allocation protocol is configured for determining, on the basis of entry data received from a given player in respect of the gaming activity, a level of gaming value for allocation to the player;

a component configured for communication with an information source that maintains data indicative of a carbon credit allocation protocol, wherein the carbon credit allocation protocol is configured for determining, on the basis of entry data received from a given player in respect of the gaming activity, a level of carbon credit value for allocation to the player, wherein the level of carbon credit value has an associated environmental utilitarian value aspect and an associated financial value aspect; and a component configured for processing entry data for a given player based on the entry allocation protocol and the carbon credit allocation protocol, thereby to determine a level of gaming value and a level of carbon credit value for allocation to that player; and a component for providing signals for effecting the allocation to the player of the determined level of gaming value and the determined level of carbon credit value;

wherein outcome data is defined in respect of the gaming activity for allowing for the identification of one or more winning entries, and wherein the determining of a level of carbon credit value for allocation to the player is independent of the outcome data.

8. A system according to claim 7 wherein the level of carbon credit value corresponds to a specified number of one or more carbon credits or a specified value of carbon credits.

9. A system according to claim 7 wherein the signals include data indicative of an instruction to increase the level of carbon credit value in an account associated with the player by the determined level of carbon credit value.

10. A system according to claim 7 wherein the signals include data indicative of an instruction to generate receipt data for the player in respect of the determined level of carbon credit value.

11. A system according to claim 7 including:

a component configured to receive outcome data for the gaming activity, wherein the outcome data allows for the identification of one or more winning entries for the gaming activity; and a component configured to provide signals for effecting, in accordance with a predetermined prize distribution protocol, the allocation of prizes to the players to whom winning entries were allocated.

12. A system according to claim 7 wherein the level of carbon credit value has a defined utilitarian value and a variable financial value.

13. A computer program product within a non-transitory medium including:

a component configured to communicate with an information source that maintains data indicative of an entry allocation protocol in relation to a gaming activity wherein a plurality of players provide respective entry fees, wherein the entry allocation protocol is configured for determining, on the basis of entry data received from a given player in respect of the gaming activity, a level of gaming value for allocation to the player;

a component configured for communication with an information source that maintains data indicative of a carbon credit allocation protocol, wherein the carbon credit allocation protocol is configured for determining, on the basis of entry data received from a given player in respect of the gaming activity, a level of carbon credit value for allocation to the player; and a component configured for processing entry data for a given player based on the entry allocation protocol and the carbon credit allocation protocol, thereby to determine a level of gaming value and a level of carbon credit value for allocation to that player, wherein the level of carbon credit value has an associated environmental utilitarian value aspect and an associated financial value aspect; and a component for providing signals for effecting the allocation to the player of the determined level of gaming value and the determined level of carbon credit value;

wherein outcome data is defined in respect of the gaming activity for allowing for the identification of one or more winning entries, and wherein the determining of a level of carbon credit value for allocation to the player is independent of the outcome data.

14. A computer program product according to claim 13 wherein the level of carbon credit value corresponds to a specified number of one or more carbon credits or a specified value of carbon credits.

15. A computer program product according to claim 13 wherein the signals include data indicative of an instruction to increase the level of carbon credit value in an account associated with the player by the determined level of carbon credit value.

16. A computer program product according to claim 13 wherein the signals include data indicative of an instruction to generate receipt data for the player in respect of the determined level of carbon credit value.

17. A computer program product according to claim 13 including:

a component configured to receive outcome data for the gaming activity, wherein the outcome data allows for the identification of one or more winning entries for the gaming activity; and a component configured to provide signals for effecting, in accordance with a predetermined prize distribution protocol, the allocation of prizes to the players to whom winning entries were allocated.

18. A computer program product according to claim 13 wherein the level of carbon credit value has a defined utilitarian value and a variable financial value.

19. An information management system for a gaming activity wherein a plurality of players provide respective entry fees, the system including:

a component configured for implementing an entry fee apportionment protocol that defines the apportionment of a given monetary entry fee received in respect of the gaming activity between a plurality of portions, the portions including:

(i) an administrator income portion, for providing income to an administrator of the gaming activity;

(ii) a prize pool generation portion, for funding a prize pool in respect of the gaming activity; and (iii) a carbon credit procurement portion, for the procurement of carbon credit value, that carbon credit value being for allocation to players of the gaming;

a component configured to implement an entry allocation protocol in relation to the gaming activity, wherein the entry allocation protocol controls the allocation of gaming value to a given player; and a component configured to implement a carbon credit allocation protocol in relation to the gaming activity, wherein the carbon credit allocation protocol controls the allocation of carbon credit value to a given player based on the carbon credit procurement portion of that player's entry fee;

wherein outcome data is defined in respect of the gaming activity for allowing for the identification of one or more winning entries, and wherein the allocation of carbon credit value is independent of the outcome data.

20. A system according to claim 19 wherein the entry allocation protocol controls the allocation of gaming value to a given player the based on the prize pool generation portion of that player's entry fee.

21. A system according to claim 19 wherein the entry allocation protocol controls the allocation of gaming value to a given player such that the player receives gaming value corresponding to the total entry fee provided by that player.

22. A system according to claim 19 wherein the carbon credit procurement portion is provided to a party responsible for the issuance of carbon credits.

23. A system according to claim 19 wherein the carbon credit procurement portion is provided to a party that partakes in predefined activities for the generation of carbon credits.

24. A system according to claim 19 a given unit of carbon credit value has a defined utilitarian value and a variable financial value.

* * * * *